US012624467B1

(12) United States Patent
Ehsan et al.

(10) Patent No.: US 12,624,467 B1
(45) Date of Patent: May 12, 2026

(54) TRIMETALLIC IRON NICKEL VANADIUM OXIDE (FeNiVOx) COMPOSITE CATALYSTS DEPOSITED ON NICKEL FOAM FOR ENHANCED OXYGEN EVOLUTION REACTION

(71) Applicant: King Fahd University of Petroleum and Minerals, Dhahran (SA)

(72) Inventors: Muhammad Ali Ehsan, Dhahran (SA); Abbas Saeed Hakeem, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 19/244,178

(22) Filed: Jun. 20, 2025

(51) Int. Cl.

| | |
|---|---|
| ***C25B 11/077*** | (2021.01) |
| ***C25B 11/031*** | (2021.01) |
| ***C25B 11/052*** | (2021.01) |
| ***C25B 11/061*** | (2021.01) |

(52) U.S. Cl.
CPC ..... *C25B 11/077* (2021.01); *C25B 11/031* (2021.01); *C25B 11/052* (2021.01); *C25B 11/061* (2021.01)

(58) Field of Classification Search
None
See application file for complete search history.

(56) References Cited

U.S. PATENT DOCUMENTS

2024/0102188 A1 3/2024 Matienzo et al.

FOREIGN PATENT DOCUMENTS

| | | | | |
|---|---|---|---|---|
| CN | 114481199 A | 5/2022 | | |
| CN | 118272835 A | 7/2024 | | |
| ES | 2 985 482 A1 | 11/2024 | | |
| WO | WO-2015087168 A2 * | 6/2015 | ..... | C25B 11/091 |

OTHER PUBLICATIONS

CN13481535; Google translation Sep. 14, 2025.*

(Continued)

*Primary Examiner* — Guinever S Gregorio
(74) *Attorney, Agent, or Firm* — Oblon, McClelland, Maier & Neustadt, L.L.P.

(57) ABSTRACT

A catalyst includes an iron nickel vanadium oxide ($FeNiVO_x$) nanocomposite on a nickel foam (NF). The $FeNiVO_x$ nanocomposite has an iron (Fe) content ranging from 10 atomic percent (at. %) to 25 at. %, a nickel (Ni) content ranging from 10 at. % to 25 at. %, and a vanadium (V) content ranging from 18 at. % to 32 at. %. The catalyst is formed through aerosol-assisted chemical vapor deposition depositing Fe, Ni, and V oxides onto the NF. The $FeNiVO_x$ nanocomposite forms particles on the NF, the NF having 20 to 60 pores per centimeter (pores/cm) and a porosity from 90 percent (%) to 99%. Furthermore, the catalyst has an electrochemical active surface area (ECSA) greater than or equal to 140 $cm^2$ and the catalyst has a minimum overpotential of less than or equal to 430 mV at 1 amperes per square centimeter ($A \cdot cm^{-2}$) when used to catalyze the oxygen evolution reaction.

19 Claims, 37 Drawing Sheets

(56) References Cited

OTHER PUBLICATIONS

CN114481199; abstract; Sep. 14, 2025.*
CN114481199; Google translation Sep. 14, 2025.*
Zhao et al.; Boosting electrocatalytic water oxidation by vanadium-iron-nickel trimetal hydroxide catalysts through interphase ionic migration method; Inorg. Chem. Front., 10, 2697; 2023.*
Zhao et al. supplemental Material; Boosting electrocatalytic water oxidation by vanadium-iron-nickel trimetal hydroxide catalysts through interphase ionic migration method; Inorg. Chem. Front., 10, 2697; 2023.*
Zihe Wu, et al., "High-Valence Transition Metal Modified FeNiV Oxides Anchored on Carbon Fiber Cloth for Efficient Oxygen Evolution Catalysis", Advanced Fiber Materials, vol. 4, Mar. 4, 2022, pp. 774-785.
Wenjing Wan, et al., "Tailoring electronic structure of Ni—Fe oxide by V incorporation for effective electrocatalytic water oxidation", Applied Surface Science, vol. 611, Part A, Nov. 17, 2022, 155732, Excerpts only, 6 pages.

* cited by examiner

TRIMETALLIC IRON NICKEL VANADIUM OXIDE (FeNiVOx) COMPOSITE CATALYSTS DEPOSITED ON NICKEL FOAM FOR ENHANCED OXYGEN EVOLUTION REACTION

CROSS-REFERENCE TO RELATED APPLICATION

The present disclosure claims the benefit of Saudi Patent Application No. 1020254103 filed on Jun. 10, 2025, with the Saudi Authority for Intellectual Property Office, which is incorporated herein by reference in its entirety.

STATEMENT REGARDING PRIOR DISCLOSURE BY THE INVENTORS

Aspects of the present disclosure are described in Ehsan, M., et al., "Controlled deposition of trimetallic Fe—Ni—V oxides on nickel foam as high-performance electrocatalysts for oxygen evolution reaction" published in Volume 98, International Journal of Hydrogen Energy, which is incorporated herein by reference in its entirety.

STATEMENT OF ACKNOWLEDGEMENT

Support provided by the Interdisciplinary Research Center for Hydrogen Technologies and Carbon Management, King Fahd University of Petroleum and Minerals, Saudi Arabia, is gratefully acknowledged.

BACKGROUND

Technical Field

The present disclosure is directed towards a catalyst, and more particularly trimetallic iron nickel vanadium oxide ($FeNiVO_x$) composite catalysts deposited on nickel foam (NF) for enhanced oxygen evolution reaction (OER).

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

Fossil fuels dominate global energy use, leading to resource depletion and environmental damage, emphasizing the urgent need for sustainable alternatives. Hydrogen ($H_2$) has emerged as a clean energy alternative with high energy density and zero carbon emissions, offering a viable solution to meet future energy demands and combat climate change [Sikiru, S., et al., Hydrogen-powered horizons: Transformative technologies in clean energy generation, distribution, and storage for sustainable innovation, *International Journal of Hydrogen Energy*, Volume 56, 2024, Pages 1152-1182]. Abundant hydrogen is required for use as a fuel, as pure reserves are insufficient on Earth. However, hydrogen can be produced from fossil fuels, coal, and water through various processing methods [Megia, P., et al., Hydrogen production technologies: From fossil fuels toward renewable sources. A mini review, *Energy Fuels,* 2021, 35, 20, 16403-16415]. Hydrogen production through water oxidation has gained attention as a core technology for renewable energy storage in the form of chemical fuel. However, water oxidation via electrolysis remains challenging due to high anodic overpotential and slow reaction rate of the oxygen ($O_2$) evolution reaction (OER, $4OH^- \rightarrow 2H_2O + 4e^- + O_2$ in alkaline media). Therefore, research has been conducted on electrochemical water splitting as a method to achieve clean and scalable hydrogen energy [Hassan, N. et al., Recent review and evaluation of green hydrogen production via water electrolysis for a sustainable and clean energy society, *International Journal of Hydrogen Energy*, Volume 52, Part B, 2024, Pages 420-441].

Traditional hydrogen production methods, such as steam methane reforming, coal gasification, and biological processes, faced drawbacks, including high carbon emissions, low efficiency, and elevated costs. These limitations highlighted the need for cleaner and more efficient alternatives, making electrocatalysis a promising and sustainable solution for hydrogen generation. Among electrocatalytic methods, electrochemical water splitting is a useful approach, involving two major steps of the hydrogen evolution reaction (HER) and the oxygen evolution reaction (OER), both of which are energy-intensive processes [Li, L., et al., Metallic nanostructures with low dimensionality for electrochemical water splitting, *Chem. Soc. Rev.,* 2020, 49, 3072-3106]. OER receives attention because of its intricate electron-proton transfer process, which hinders reaction kinetics and necessitates a high overpotential for efficient progress [She, L., et al., On the durability of iridium-based electrocatalysts toward the oxygen evolution reaction under acid environment, *Adv. Funct. Mater.,* 2022, 32, 2108465]. Therefore, designing electrocatalytic systems that are affordable, sustainable, and capable of high conductivity with efficient electron transfer is needed to overcome the kinetic challenges associated with OER. In response, researchers have focused on developing catalysts that combine high activity with long-term durability, enabling OER to proceed rapidly while minimizing energy consumption. Moreover, to enhance productivity and reduce costs, these catalysts should be made from abundant and cost-effective materials.

Extensive research on noble metal oxides such as iridium dioxide ($IrO_2$) and ruthenium dioxide ($RuO_2$) exhibit high catalytic activity in OER processes, but high cost and limited availability make them inappropriate for the development of commercial electrolyzers [Fabbri, E., et al., Developments and perspectives of oxide-based catalysts for the oxygen evolution reaction, *Catal. Sci. Technol.,* 2014, 4, 3800-3821]. However, in monometallic catalysts, the energetics of the water oxidation process suggest that intermediates, such as *OH, *O, and *OOH, are either adsorbed too weakly or too strongly on the surface [Bonke., S., et al., Parameterization of water electrooxidation catalyzed by metal oxides using fourier transformed alternating current voltammetry, *J. Am. Chem. Soc.,* 2016, 138, 49, 16095-16104]. In this context, the first-row transition elements ranging from vanadium (V) to copper (Cu) have attracted considerable attention. Different combinations of these elements, including oxides [Zhang, L., et al., First-row transition metal oxide oxygen evolution electrocatalysts: regulation strategies and mechanistic understandings, *Sustainable Energy Fuels,* 2020, 4, 5417-5432], hydroxides, oxyhydroxides [Sahoo D., et al., Recent progress in first row transition metal Layered double hydroxide (LDH) based electrocatalysts towards water splitting: A review with insights on synthesis, *Coordination Chemistry Reviews*, Volume 469, 2022, 214666], sulfides/selenides [Majhi K., et al., Transition metal-based chalcogenides as electrocatalysts for overall water splitting, *ACS Eng. Au,* 2023, 3, 5, 278-284], nitrides [Das, C., et al., Transition Metal Non-Oxides as Electrocatalysts: Advantages and Challenges, *Small,* 2022, 18, 2202033], and other analogues, have been extensively explored.

In selecting appropriate metals, the catalytic activity is influenced by the synthesis method employed. The structural properties such as crystallinity, morphology, and active sites play a role in enhancing catalytic characteristics, and these properties are directly shaped by the fabrication method [Zhou, B., et al., Surface design strategy of catalysts for water electrolysis, *Small,* 2022, 18, 2202336]. However, some fabrication processes may be time-consuming due to their multi-stage nature [Zhang, Q., et al., CoNi based alloy/oxides@N-doped carbon core-shell dendrites as complementary water splitting electrocatalysts with significantly enhanced catalytic efficiency, Applied Catalysis B: Environmental, Volume 254, 2019, pages 634-646]. Additionally, binding agents may suppress active sites, potentially reducing catalytic performance instead of enhancing it. This concern has driven research toward developing thin film electrocatalysts. Unlike powder-based catalysts, thin films grow directly on the substrate at high temperatures without binding agents, maintaining structural integrity while improving OER rate through increased surface area and efficient mass transport [Xie, X., et al, Oxygen evolution reaction in alkaline environment: material challenges and solutions, *Adv. Funct. Mater.,* 2022, 32, 2110036]. Such advanced and precisely engineered catalysts improve water splitting efficiency by providing enhanced catalytic activity, stability, and cost-effectiveness.

Accordingly, one object of the present disclosure is to provide a trimetallic nanocomposite catalyst for efficient water splitting reactions, that may circumvent the drawbacks and limitations, such as poor stability, high overpotential, and complex synthesis procedures, of the methods and materials already known in the art.

SUMMARY

In an exemplary embodiment, a catalyst is described. The catalyst includes an iron nickel vanadium oxide ($FeNiVO_x$) nanocomposite on a nickel foam (NF). The $FeNiVO_x$ nanocomposite has an iron (Fe) content in a range from 10 atomic percent (at. %) to 25 at. %, a nickel (Ni) content in a range from 10 at. % to 25 at. %, and a vanadium (V) content in a range from 18 at. % to 32 at. %. Further, the catalyst is formed through aerosol-assisted chemical vapor deposition (AACVD) depositing Fe, Ni, and V oxides onto the NF. The $FeNiVO_x$ nanocomposite is in the form of particles on the NF. The NF has 20 pores per centimeter (pores/cm) to 60 pores/cm and a porosity from 90 percent (%) to 99%. Furthermore, the catalyst has an electrochemical active surface area (ECSA) greater than or equal to (≥) 140 centimeter square ($cm^2$) and the catalyst has a minimum overpotential of less than or equal to (≤) 430 millivolts (mV) at 1 amperes per square centimeter ($A \cdot cm^{-2}$) when used to catalyze the oxygen evolution reaction (OER).

In some embodiments, the $FeNiVO_x$ nanocomposite is in the form of spherical particles.

In some embodiments, the $FeNiVO_x$ nanocomposite has a Fe content in a range from 14 at. % to 18 at. %, a Ni content in a range from 15 at. % to 19 at. %, and a V content in a range from 22 at. % to 28 at. %.

In some embodiments, the $FeNiVO_x$ nanocomposite has a Fe content of 16 at. %, a Ni content of 17 at. %, and a V content of 25 at. %.

In some embodiments, the catalyst has a minimum overpotential of less than or equal to 400 mV at 1 $A \cdot cm^{-2}$ when used to catalyze OER.

In some embodiments, the catalyst has a minimum overpotential of less than or equal to 370 mV at 1 $A \cdot cm^{-2}$ when used to catalyze OER.

In some embodiments, the catalyst has an ECSA greater than or equal to 200 $cm^2$.

In some embodiments, the catalyst has an ECSA greater than or equal to 280 $cm^2$.

In some embodiments, the catalyst has a minimum overpotential of less than or equal to 320 mV at 10 milliamperes per square centimeter ($mA \cdot cm^{-2}$) when used to catalyze OER.

In some embodiments, the catalyst has a minimum overpotential of less than or equal to 270 mV at 10 $mA \cdot cm^{-2}$ when used to catalyze OER.

In some embodiments, the catalyst has a minimum overpotential of less than or equal to 250 mV at 10 $mA \cdot cm^{-2}$ when used to catalyze OER.

In some embodiments, the catalyst has an onset potential of less than or equal to 300 mV at 1.51 volts (V) vs reversible hydrogen electrode (RHE) when used to catalyze OER.

In some embodiments, the catalyst has an onset potential of less than or equal to 270 mV at 1.49 V vs RHE when used to catalyze OER.

In some embodiments, the catalyst has an onset potential of less than or equal to 240 mV at 1.46 V vs RHE when used to catalyze OER.

In some embodiments, the catalyst has a charge transfer resistance ($R_{ct}$) value in a range from 2.0 ohms (Ω) to 2.4Ω when used to catalyze OER.

In some embodiments, the catalyst has an $R_{ct}$ value in a range from 1.3Ω to 1.7Ω when used to catalyze OER.

In some embodiments, the catalyst has an $R_{ct}$ value in a range from 1.1Ω to 1.5Ω when used to catalyze OER.

In some embodiments, the catalyst has a turnover frequency (TOF) in a range from 0.65 $s^{-1}$ to 0.8 $s^{-1}$ at an overpotential of 350 mV when used to catalyze OER.

In some embodiments, the catalyst has a TOF in a range from 0.2 $s^{-1}$ to 0.3 $s^{-1}$ at an overpotential of 350 mV when used to catalyze OER.

In some embodiments, the catalyst has a TOF in a range from 0.15 per second ($s^{-1}$) to 0.25 $s^{-1}$ at an overpotential of 350 mV when used to catalyze OER.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
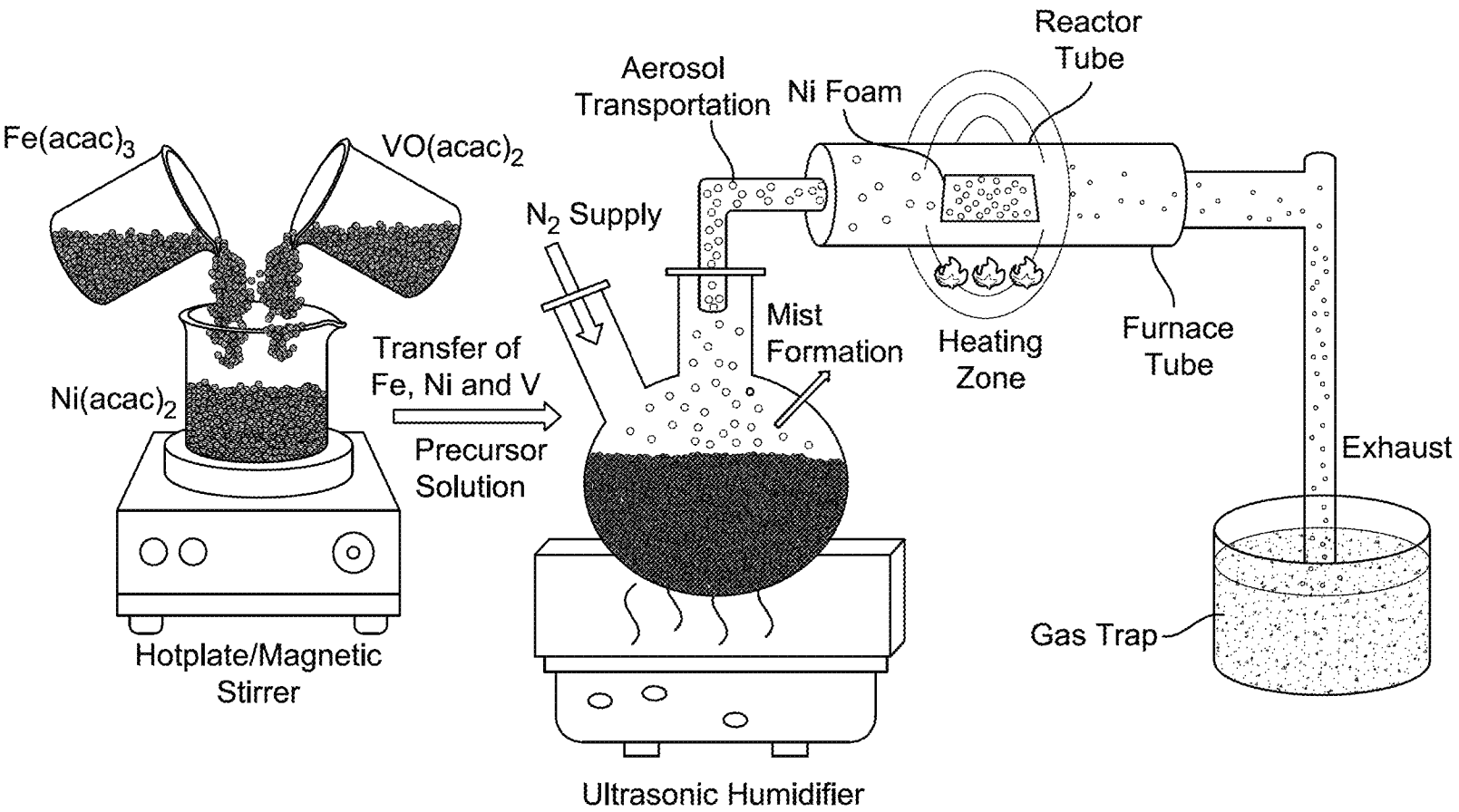
FIG. 1 illustrates a schematic representation of the deposition process for trimetallic iron nickel vanadium oxide ($FeNiVO_x$) composite catalysts on nickel foam (NF) using the aerosol-assisted chemical vapor deposition (AACVD) method, according to certain embodiments.

When describing the present disclosure, the terms used are to be construed in accordance with the following definitions, unless a context dictates otherwise.

Embodiments of the present disclosure will now be described more fully hereinafter with reference to the accompanying drawings wherever applicable, in that some, but not all, embodiments of the disclosure are shown.

In the drawings, like reference numerals designate identical or corresponding parts throughout the several views. Further, as used herein, the words 'a,' 'an' and the like generally carry a meaning of 'one or more,' unless stated otherwise.

Furthermore, the terms 'approximately,' 'approximate,' 'about,' and similar terms generally refer to ranges that include the identified value within a margin of 20%, 10%, or preferably 5%, and any values therebetween.

When amounts, concentrations, dimensions and other parameters are expressed in the form of a range, a preferable range, an upper limit value, a lower limit value or preferable upper and limit values, it should be understood that any ranges obtainable by combining any upper limit or preferable value with any lower limit or preferable value are also specifically disclosed, irrespective of whether the obtained ranges are clearly mentioned in the context.

As used herein, the term 'room temperature' refers to a temperature range of '25 degrees Celsius (° C.)±3° C. in the present disclosure.

As used herein, the term 'nanoparticles (NPs)' refers to particles having a particle size of 1 nanometer (nm) to 1000 nm within the scope of the present disclosure.

As used herein, the term 'nanocomposite' refers to a composite material that has at least one component with a grain size measured in nanometers.

As used herein, the term 'nanohybrid composite' refers to a material that combines nanomaterials (such as NPs, nanotubes, or nanofibers) with another material, typically a polymer, metal, or ceramic, to form a composite structure. The nanomaterials are typically incorporated at the nanoscale level to enhance the properties of the base material, such as improving strength, conductivity, or flexibility, while maintaining the advantages of both components. The resulting nanohybrid composite exhibits unique properties that are enhanced compared to the individual materials alone.

As used herein, the term 'pore' refers to a small opening or space in a material, such as rock or soil, through which fluids or gases can pass.

As used herein, the term 'porosity' refers to a measure of the void or vacant spaces within a material.

As used herein, the term 'aerosol-assisted chemical vapor deposition (AACVD)' refers to a deposition technique in which a precursor solution is converted into an aerosol and transported to a heated substrate, where it undergoes decomposition or reaction to form a thin film or nanostructured material.

As used herein, the term 'electrode' refers to an electrical conductor used to contact a non-metallic part of a circuit, such as a semiconductor, an electrolyte, a vacuum, or air.

As used herein, 'working electrode', refers to an electrode in an electrochemical cell/device/sensor on which the electrochemical reaction of interest is occurring.

As used herein, 'counter-electrode', refers to an electrode used in an electrochemical cell for voltametric analysis or other reactions in which an electric current flows.

As used herein, the term 'electrolyte' refers to substances that conduct electric current because of dissociation of the electrolyte into positively and negatively charged ions.

As used herein, the term 'catalyst' refers to a substance that speeds up a chemical reaction without being consumed or permanently changed in the process.

As used herein, the term 'electrocatalyst' refers to a substance that accelerates the rate of an electrochemical reaction by lowering the activation energy without being consumed in the process.

As used herein, the term 'current density' refers to the amount of electric current traveling per unit cross-section area.

As used herein, the term 'water splitting' refers to the chemical reaction in which water is broken down into oxygen and hydrogen, represented by the chemical equation:

$$2H_2O \rightarrow 2H_2 + O_2.$$

As used herein, the term 'electrochemical active surface area (ECSA)' refers to the effective surface area of a catalyst that actively participates in electrochemical reactions, typically determined through techniques such as cyclic voltammetry or electrochemical impedance spectroscopy.

As used herein, the term 'oxygen evolution reaction (OER)' refers to the electrochemical process in which water is oxidized to produce molecular oxygen, typically occurring at the anode during water splitting, and is a half-reaction in electrolyzers and renewable energy conversion systems.

As used herein, the term 'overpotential' refers to the extra potential required beyond the thermodynamic equilibrium potential to drive an electrochemical reaction at a desired rate, typically influenced by kinetic, ohmic, and mass transport limitations.

As used herein, the term 'reversible hydrogen electrode (RHE)' refers to a reference electrode whose potential is defined based on the hydrogen redox reaction in an aqueous solution at standard conditions, and is commonly used for electrochemical measurements.

As used herein, the term 'onset potential' refers to the minimum potential at which an electrochemical reaction, such as the OER, begins to occur at a measurable rate, serving as an indicator of a catalyst's activity.

As used herein, the term 'turnover frequency (TOF)' refers to the number of catalytic reactions occurring per active site per unit time, commonly used to evaluate the intrinsic activity and efficiency of an electrocatalyst.

As used herein, the term 'charge transfer resistance ($R_{ct}$)' refers to the resistance associated with the transfer of electrons between an electrode and the electrolyte during an electrochemical reaction, typically measured using electrochemical impedance spectroscopy (EIS) to assess catalyst performance and reaction kinetics.

As used herein, the term 'double layer capacitance ($C_{dl}$)' refers to the capacitance that forms at the interface between an electrode and an electrolyte. It is a result of the separation of charge, with one layer of charge accumulating on the electrode surface and the opposite layer forming in the electrolyte, creating an electric double layer.

A weight percent of a component, unless specifically stated to the contrary, is based on the total weight of the formulation or composition in which the component is included. For example, if a particular element or component in a composition or article is said to have 5 wt. %, it is understood that this percentage is in relation to a total compositional percentage of 100%.

The present disclosure is intended to include all hydration states of a given compound or formula, unless otherwise noted or when heating a material.

In addition, the present disclosure is intended to include all isotopes of atoms occurring in the present compounds and complexes. Isotopes include those atoms having the same atomic number but different mass numbers. By way of general example, and without limitation, isotopes of hydrogen include deuterium and tritium, and isotopes of carbon include $^{13}C$ and $^{14}C$. Isotopes of naturally occurring nickel $^{28}Ni$ include $^{58}Ni$, $^{60}Ni$, $^{61}Ni$, $^{62}Ni$, and $^{64}Ni$. Isotopes of iron include $^{54}Fe$, $^{56}Fe$, $^{57}Fe$, and $^{58}Fe$. Isotopes of oxygen include $^{16}O$, $^{17}O$, and $^{18}O$. Isotopically-labeled compounds of the disclosure may generally be prepared by conventional techniques known to those skilled in the art or by processes analogous to those described herein, using an appropriate isotopically-labeled reagent in place of the non-labeled reagent otherwise employed.

Aspects of the present disclosure are directed to the fabrication of trimetallic iron nickel vanadium oxide ($FeNiVO_x$) composite catalysts on nickel foam (NF) using aerosol-assisted chemical vapor deposition (AACVD) to enhance OER kinetics in water splitting applications. The designed catalysts may serve as promising alternatives to noble metal catalysts for the construction of affordable and clean energy water splitting devices.

A catalyst is described. The catalyst includes a $FeNiVO_x$ nanocomposite on a NF. In some embodiments, the catalyst may be formed through sol-gel synthesis, hydrothermal synthesis, precipitation method, electrodeposition, microwave-assisted synthesis, mechanochemical synthesis, atomic layer deposition, sputtering, flame spray pyrolysis, and electrospinning. In some embodiments, electrode may be formed using one of the techniques like the drop-casting method, spray coating, spin coating, dip coating, physical vapor deposition (PVD), AACVD, or molecular beam epitaxy (MBE). In a preferred embodiment, the catalyst is formed through AACVD depositing Fe, Ni, and V oxides onto the NF.

In some embodiments, the $FeNiVO_x$ nanocomposite includes sheet morphologies, preferably nanosheets, although other morphologies such as nanowires, nanospheres, nanocrystals, nanorectangles, nanotriangles, nanopentagons, nanohexagons, nanoprisms, nanodisks, nanocubes, nanoribbons, nanoblocks, nanotoroids, nanodiscs, nanobarrels, nanogranules, nanowhiskers, nanoflakes, nanofoils, nanopowders, nanoboxes, nanobeads, nanobelts, nanourchins, nanoflowers, nanostars, tetrapods, and their mixtures thereof are also possible. In a preferred embodiment, the $FeNiVO_x$ nanocomposite is in the form of particles on the NF. In one or more embodiments, the catalyst has synergistic interactions among heteroatoms. In one or more embodiments, the $FeNiVO_x$ nanocomposite is in the form of spherical particles.

In some embodiments, the nanocomposite is porous. Pores may be micropores, mesopores, macropores, and/or a combination thereof. Pores exist in the bulk material, not necessarily in the molecular structure of the material. The term 'microporous' means that nanocomposite have pores with an average pore width (i.e. diameter) of less than 2 nm. The term 'mesoporous' means the pores of the nanocomposite have an average pore width of 2-50 nm. The term 'macroporous' means the pores of nanocomposite have an average pore width larger than 50 nm. Pore size may be determined by methods including, but not limited to, gas adsorption (e.g. $N_2$ adsorption), mercury intrusion porosimetry, and imaging techniques such as scanning electron microscopy (SEM), and X-ray computed tomography (XRCT).

In some embodiments, the NF has 10 to 80 pores per centimeter (pores/cm), preferably 20 to 60 pores/cm, preferably 25 to 55 pores/cm, preferably 30 to 50 pores/cm, and preferably 35 to 45 pores/cm. In a preferred embodiments, the NF has 40 pores/cm. In some embodiments, the NF has a porosity from 10 to 99%, preferably 90 to 99%, preferably 91-98%, preferably 92-97%, preferably 93-96%, and preferably 94-95%.

In some embodiments, the $FeNiVO_x$ nanocomposite has a Fe content in a range from 5-35 atomic (at. %), preferably 10-25 at. %, preferably 12-23 at. %, preferably 14-21 at. %, preferably 15-19 at. %, and preferably 16-17 at. %. In a preferred embodiment, the $FeNiVO_x$ nanocomposite has a Fe content of 16 at. %. In some embodiments, the $FeNiVO_x$ nanocomposite has a Ni content in a range from 5-35 at. %, preferably 10-25 at. %, preferably 12-23 at. %, preferably 14-21 at. %, preferably 16-19 at. %, and preferably 17-18 at. %. In a preferred embodiment, the $FeNiVO_x$ nanocomposite has a Ni content of 17 at. %. In some embodiments, the $FeNiVO_x$ nanocomposite has a V content in a range from 10-45 at. %, preferably 18-32 at. %, preferably 20-30 at. %, preferably 22-28 at. %, and preferably 24-26 at. %. In a preferred embodiments, the $FeNiVO_x$ nanocomposite has a V content of 25 at. %.

In some embodiments, the catalyst may have an ECSA greater than or equal to 100 centimeter square ($cm^2$), preferably 140 centimeter square ($cm^2$), preferably greater than or equal to 160 $cm^2$, preferably greater than or equal to 180 $cm^2$, preferably greater than or equal to 200 $cm^2$, preferably greater than or equal to 220 $cm^2$, preferably greater than or equal to 240 $cm^2$, preferably greater than or equal to 260 $cm^2$, and preferably greater than or equal to 280 $cm^2$. In a preferred embodiments, the catalyst has an ECSA of 284 $cm^2$.

In some embodiments, the catalyst is used to catalyze OER by connecting a working electrode, a reference electrode, and a counter electrode with a potentiostat in a three-electrode electrochemical cell. The working electrode is $FeNiVO_x$—NF nanocomposite. A reference electrode is an electrode that has a stable and well-known electrode potential. The high stability of the electrode potential is usually reached by employing a redox system with constant (buffered or saturated) concentrations of each relevant species of the redox reaction. A reference electrode may enable the potentiostat to deliver a stable voltage to the working electrode or the counter electrode. The reference electrode may be a standard hydrogen electrode (SHE), a normal hydrogen electrode (NHE), RHE, a saturated calomel electrode (SCE), a copper-copper(II) sulfate electrode (CSE), a silver chloride electrode (Ag/AgCl), a pH-electrode, a palladium-hydrogen electrode, a dynamic hydrogen electrode (DHE), a mercury-mercurous sulfate electrode, mercury/mercuric oxide (Hg/HgO) electrode, or some other type of electrode. In a preferred embodiment, a reference electrode is Ag/AgCl electrode. However, in some embodiments, the electrochemical cell does not include a reference electrode.

In some embodiments, the counter electrode is made from a material selected from the group consisting of platinum, gold, and carbon. In some embodiments, the counter electrode may contain an electrically-conductive material such as platinum, platinum-iridium alloy, iridium, titanium, titanium alloy, stainless steel, gold, cobalt alloy, and/or some other electrically-conductive material, where an "electrically-conductive material" as defined here is a substance with an electrical resistivity of at most $10^{-6}$ Ω·m, preferably at most $10^{-7}$ Ω·m, more preferably at most $10^{-8}$ Ω·m at a temperature of 20-25° C. The form of the counter electrode may be generally relevant only in that it needs to supply sufficient current to the electrolyte solution to support the current required for the electrochemical reaction of interest. The counter electrode material should thus be sufficiently inert to withstand the chemical conditions in the electrolyte solution, such as acidic or basic pH values, without substantially degrading during the electrochemical reaction. The counter electrode should preferably not leach out any chemical substance that interferes with the electrochemical reaction or might lead to undesirable electrode contamination. In a preferred embodiment, the counter electrode is platinum mesh.

The working electrode, the reference electrode, and the counter electrode are contacted with an aqueous solution acting as an electrolyte. In some embodiments, the aqueous solution is an alkali metal salt and water. In one or more embodiments, the aqueous solution includes the alkali metal salt at a concentration of 0.05-5 M, preferably 0.1-3 M, preferably 0.5-2 M, preferably 0.75-1.5 M. In a preferred embodiment, the aqueous solution includes an alkali metal salt at a concentration of 1 M. In some embodiments, the alkali metal salt is at least one selected from the group consisting of lithium hydroxide (LiOH), sodium hydroxide (NaOH), potassium hydroxide (KOH) and rubidium hydroxide (RbOH), and cesium hydroxide (CsOH). In a preferred embodiment, the alkali metal salt is KOH. The water may be tap water, distilled water, bidistilled water, deionized water, deionized distilled water, reverse osmosis water, and/or some other water. Preferably, to maintain uniform concentrations and/or temperatures of the electrolyte solution, the electrolyte solution may be stirred or agitated during the electrochemical reaction. The stirring or agitating may be done intermittently or continuously. This stirring or agitating may be done by a magnetic stir bar, a stirring rod, an impeller, a shaking platform, a pump, a sonicator, a gas bubbler, or some other device. Preferably, the stirring is done by an impeller or a magnetic stir bar.

In some embodiments, the catalyst is used to catalyze OER and generate oxygen. The oxygen is generated at the working electrode. The oxygen may be generated by decomposing water into $H_2$ and $O_2$. In one embodiment, the space above each electrode may be confined to a vessel to receive or store the evolved gases from one or both electrodes. The collected gas may be further processed, filtered, or compressed. Preferably, the $H_2$-enriched gas is collected above the cathode, and the $O_2$-enriched gas is collected above the anode. The electrolytic cell, or an attachment, may be shaped so that the headspace above the working electrode is kept separate from the headspace above the reference electrode. In one embodiment, the $H_2$-enriched gas and the $O_2$-enriched gas are not 100 vol % $H_2$ and 100 vol % $O_2$, respectively. For example, the enriched gases may also include $N_2$ from the air, water vapor, and other dissolved gases from the electrolyte solution. The $H_2$-enriched gas may also include $O_2$ from the air. The $H_2$-enriched gas may include greater than 20 vol % $H_2$, preferably greater than 40 vol % $H_2$, more preferably greater than 60 vol % $H_2$, and even more preferably greater than 80 vol % $H_2$, relative to a total volume of the receptacle collecting the evolved $H_2$ gas. The $O_2$-enriched gas may include greater than 20 vol % $O_2$, preferably greater than 40 vol % $O_2$, more preferably greater than 60 vol % $O_2$, and even more preferably greater than 80 vol % $O_2$, relative to a total volume of the receptacle collecting the evolved $O_2$ gas. In some embodiments, the evolved gases may be bubbled into a vessel, including water or some other liquid, and higher concentrations of $O_2$ or $H_2$ may be collected. In one embodiment, evolved $O_2$ and $H_2$, or $H_2$-enriched gas and $O_2$-enriched gas, may be collected in the same vessel.

In some embodiments, the catalyst may have a minimum overpotential of less than or equal to 500 mV, preferably less than or equal to 430 mV, preferably less than or equal to 410 mV, preferably less than or equal to 390 mV, preferably less than or equal to 380 mV at 1 $A \cdot cm^{-2}$ when used to catalyze OER. In a preferred embodiment, the catalyst has a minimum overpotential of less than or equal to 370 mV at 1 $A \cdot cm^{-2}$ when used to catalyze the OER. In some embodiments, the catalyst has a minimum overpotential of 320 mV, preferably less than or equal to 300 mV, less than or equal to 290 mV, less than or equal to 270 mV, less than or equal to 260 mV at 10 $mA \cdot cm^{-2}$ when used to catalyze OER. In a preferred embodiment, the catalyst has a minimum overpotential of less than or equal to 250 mV at 10 $mA \cdot cm^{-2}$ when used to catalyze the OER.

In some embodiments, the catalyst has an onset potential of less than or equal to 360 mV, preferably less than or equal to 330 mV, preferably less than or equal to 310 mV, preferably less than or equal to 300 mV, preferably less than or equal to 290 mV at 1.51 V vs RHE when used to catalyze OER. In a preferred embodiment, the catalyst has an onset potential of 280 mV at 1.51 V vs RHE when used to catalyze OER. In some embodiments, the catalyst has an onset potential of less than or equal to 350 mV, preferably less than or equal to 330 mV, preferably less than or equal to 310 mV, preferably less than or equal to 300 mV, preferably less than or equal to 290 mV, preferably less than or equal to 280 mV at 1.49 V vs RHE when used to catalyze OER. In a preferred embodiment, the catalyst has an onset potential of 260 mV at 1.49 V vs RHE when used to catalyze OER. In some embodiments, the catalyst has an onset potential of less than or equal to 350 mV, preferably less than or equal to 3300 mV, preferably less than or equal to 310 mV, preferably less than or equal to 300 mV, preferably less than or equal to 280 mV, preferably less than or equal to 260 mV, preferably less than or equal to 250 mV at 1.46 V vs RHE when used to catalyze OER. In a preferred embodiments, the catalyst has an onset potential of 230 mV at 1.46 V vs RHE when used to catalyze OER.

In some embodiments, the catalyst has a $R_{ct}$ value in a range from 1.5-2.9Ω, preferably 2.0-2.4Ω, preferably 2.05-2.35Ω, preferably 2.10-2.30Ω, and preferably 2.15-2.25Ω when used to catalyze OER. In some embodiments, the catalyst has a $R_{ct}$ value in a range from 1.0-2.0Ω, preferably 1.3-1.7Ω, preferably 1.35-1.65Ω, preferably 1.4-1.6Ω, and preferably 1.45-1.55Ω when used to catalyze OER. In some embodiments, the catalyst has an $R_{ct}$ value in a range from 0.8-1.8Ω, preferably 1.1-1.5Ω, preferably 1.15-1.45Ω, preferably 1.2-1.4Ω, preferably 1.25-1.35Ω when used to catalyze OER. In a preferred embodiment, the catalyst has an $R_{ct}$ value of 2.245Ω when used to catalyze OER. In another embodiment, the catalyst has an $R_{ct}$ value of 1.527Ω when used to catalyze OER. In yet another embodiment, the catalyst has an $R_{ct}$ value of 1.337Ω when used to catalyze OER.

In some embodiments, the catalyst has a TOF in a range from 0.45-1.0 $s^{-1}$, preferably 0.65-0.8 $s^{-1}$, preferably 0.66-0.79 $s^{-1}$, preferably 0.67-0.78 $s^{-1}$, preferably 0.68-0.77 $s^{-1}$, preferably 0.69-0.76 s 1, preferably 0.7-0.75 s 1, preferably 0.71-0.74 s 1, and preferably 0.72-0.73 $s^{-1}$ at an overpotential of 350 mV when used to catalyze OER. In some embodiments, the catalyst has a TOF in a range from 0.1-0.4 $s^{-1}$, preferably 0.2-0.3 $s^{-1}$, preferably 0.21-0.29 $s^{-1}$, preferably 0.22-0.28 $s^{-1}$, preferably 0.23-0.27 $s^{-1}$, and preferably 0.24-0.26 $s^{-1}$ at an overpotential of 350 mV when used to catalyze OER. In some embodiments, the catalyst has a TOF in a range from 0.10-0.30 $s^{-1}$, preferably 0.15-0.25 s 1, preferably 0.16-0.24 s 1, preferably 0.17-0.23 $s^{-1}$, preferably 0.18-0.22 $s^{-1}$, and preferably 0.19-0.21 $s^{-1}$ at an overpotential of 350 mV when used to catalyze OER. In a preferred embodiment, the catalyst has a TOF 0.72 $s^{-1}$ at an overpotential of 350 mV when used to catalyze OER. In another embodiment, the catalyst has a TOF 0.25 $s^{-1}$ at an overpotential of 350 mV when used to catalyze OER. In yet another embodiment, the catalyst has a TOF 0.19 $s^{-1}$ at an overpotential of 350 mV when used to catalyze OER.

The following examples are provided solely for illustration and are not to be construed as limitations of the present disclosure, as many variations thereof are possible without departing from the spirit and scope of the present disclosure.

EXAMPLES

The following examples demonstrate trimetallic iron nickel vanadium oxide ($FeNiVO_x$) composite catalysts on nickel foam (NF) for enhanced oxygen evolution reaction (OER). The examples are provided solely for illustration and are not to be construed as limitations of the present disclosure, as many variations thereof are possible without departing from the spirit and scope of the present disclosure.

Example 1: Materials

The chemical reagents used in the present disclosure were all analytical grades. The chemical precursors and solvents purchased from Sigma-Aldrich and used without further purification included nickel(II) acetylacetonate ($Ni(acac)_2$, 95%), iron(III) acetylacetonate ($Fe(acac)_3$, 97%), vanadium (IV) oxyacetylacetonate ($VO(acac)_2$, 98%), and analytical grade methanol. NF (95-98% porosity, 40 pores per centimeter (pores/cm)), manufactured by SCI Materials Hub, was employed for catalyst fabrication.

Example 2: Deposition of Trimetallic $FeNiVO_x$ Electrocatalyst

In the present disclosure, trimetallic $FeNiVO_x$ composite catalysts were deposited onto a NF support using a single-step aerosol-assisted chemical vapor deposition (AACVD) process [Ehsan, M., et al., Recent Advances in Processing and Applications of Heterobimetallic Oxide Thin Films by Aerosol-Assisted Chemical Vapor Deposition, *Chem. Rec.*, 2022, 22, e202100278, incorporated herein by reference in its entirety]. A schematic illustration of catalyst fabrication process via AACVD is shown in FIG. 1. An equimolar mixture of three precursors, $Fe(acac)_3$ with 50 milligrams (mg) and 141 millimoles (mmol), $Ni(acac)_2$ with 36 mg and 141 mmol, and $VO(acac)_2$ with 38 mg and 141 mmol, was prepared in 25 milliliter (mL) of methanol resulting in a transparent red color solution. This solution was then transferred into the AACVD apparatus for catalyst fabrication.

A two-neck flask including the precursor solution was placed over an ultrasonic humidifier to produce an aerosol mist, providing homogeneous mixing of three metal atoms. Industrial-grade nitrogen (99.999% purity) at a flow rate of 120 milliliters per minute (mL/min) was employed from one side of the two-neck flask to transport the aerosol mist towards the horizontal tube furnace. NF strips, of size 1 centimeter (cm)×2 cm, were positioned within a quartz reactor tube and preheated at a temperature of 475 degrees Celsius (° C.) in the furnace. Additionally, as the aerosol mist entered the heated zone of the tube furnace, the aerosol mist decomposed, releasing gaseous products that settled onto the exposed surface of the NF. As the deposition time increased, the nucleation and growth of the deposited product accelerated, resulting in a uniform coating of the catalyst.

In the present disclosure, deposition time was periodically changed from 1 hour (h) to 2 h to 3 h to fabricate three variants of composite oxides, designated as $FNVO_x$-1, $FNVO_x$-2, and $FNVO_x$-3, respectively. The supply of precursors was halted at the desired deposition time, and the furnace was allowed to cool to room temperature under a continuous flow of carrier gas. For electrochemical examinations, pristine components of $Fe_2O_3$, NiO, and $VO_2$ were also deposited from their respective precursor solutions using a similar AACVD process.

Example 3: Structural Characterization

Surface morphology of composite oxide catalysts was evaluated with field emission 5 scanning electron microscope (FESEM, TESCAN MIRA3). Elemental compositions were determined with energy dispersive X-ray spectrometer (EDX, INCA Energy 200, Oxford Instruments, UK). X-ray diffraction (XRD) patterns were measured with, Rigaku MiniFlex X-ray diffractometer in the 2θ range of 20 degrees (°)-90°. Transmission electron microscopy (TEM) was carried out using JEOL-JEM2100F, Japan, operated at an accelerating voltage of 200 kV. X-ray photoelectron spectroscopy (XPS, Thermo Scientific EscaLab 250Xi, USA) with an Al Kα source at 1486.6 electron volts (eV) was employed to examine the chemical composition and valence states of the elements.

Example 4: Electrochemical Characterization

Detailed electrochemical experiments were performed using Gamry workstation, INTERFACE 1010 E. A series of measurements including linear sweep voltammetry (LSV), cyclic voltammetry (CV), electrochemical impedance spectra (EIS) and chronopotentiometric (CP) stability were conducted to observe OER activity in 1.0 molar (M) potassium hydroxide (KOH) solution with a pH of 13.7 as the electrolyte. In a three-electrode system, the NF deposited catalyst served as the working electrode and silver/silver chloride (Ag/AgCl) and platinum (Pt) mesh were used as the reference and counter electrodes. Catalyst activation was achieved through concurrent CVs performed at 25 millivolts per second ($mVs^{-1}$). While LSV curves were recorded at a slow scan rate of 2 $mVs^{-1}$. The measured oxygen evolution reaction (OER) voltages were converted to reversible hydrogen electrode (RHE) by the Eq. (1).

$$E_{RHE}=E_{Ag/AgCl}+0.059\ pH+0.098\ V \quad (1)$$

EIS was measured over a frequency range of $10^{-1}$ hertz (Hz)-$10^{-5}$ Hz. Catalyst stability was examined by CP test conducted at applied current densities of 50 milliamperes per square centimeter ($mAcm^{-2}$) and 100 $mAcm^{-2}$ for 40 h. The electrochemically active surface area (ECSA) value, which is linearly related to the $C_{dl}$ value, was determined using this Eq. (2).

$$ECSA=C_d/C_s \quad (2)$$

where $C_s$ represents the specific capacitance for a 1 $cm^2$ electrode, typically taken as 0.04 millifarads per square centimeter ($mFcm^{-2}$) in alkaline solutions, and $C_{dl}$ is the double layer capacitance.

Figure 2:
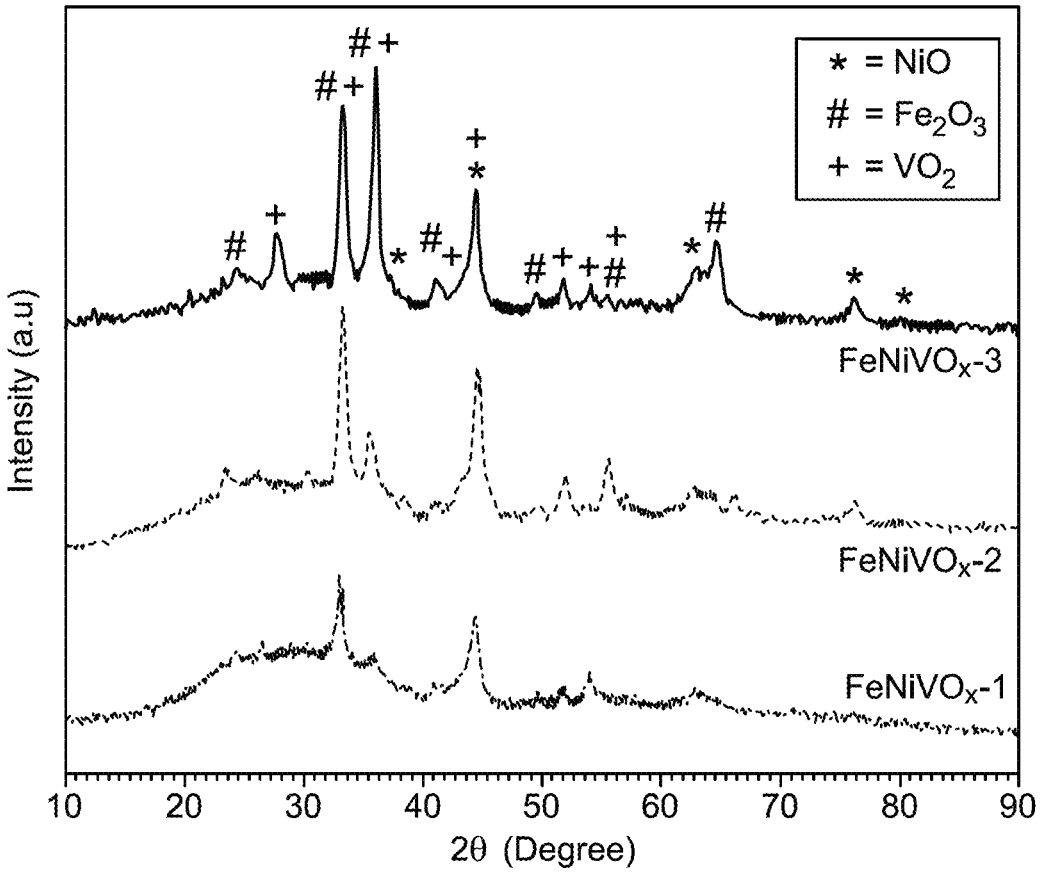
FIG. 2 shows X-ray diffraction (XRD) patterns of trimetallic composite catalysts $FeNiVO_x$-1, $FeNiVO_x$-2 and $FeNiVO_x$-3 deposited on plain glass for time periods of 1 hour (h), 2 h, and 3 h respectively, according to certain embodiments.

The trimetallic $FeNiVO_x$ composite, synthesized with varying deposition times from 1 h to 3 h, was analyzed using X-ray diffraction (XRD). To eliminate any ambiguity in the XRD analysis of the composite oxide, samples were deposited on an amorphous plain glass substrate instead of highly crystalline NF. As shown in FIG. 2, the resulting overlaid XRD patterns indicated the presence of three distinct crystalline phases including iron oxide ($Fe_2O_3$), nickel oxide (NiO), and vanadium oxide ($VO_2$).

The diffraction peaks marked with a (#) symbol at 2θ° values of 24.5°, 33.7°, 36.2°, 41.5°, 50.35°, 55.21°, and 65.0° corresponded to the Miller indices (012), (104), (110), (113), (024), (116), and (300) planes of ferric oxide ($Fe_2O_3$), respectively. These peaks exhibited consistent identification with the trigonal phase of hematite $Fe_2O_3$, as referenced by the JCPD card (No. 01-072-6228). The vanadium dioxide ($VO_2$) phase, denoted by the (+) symbol, was identified at 2θ° values of 28.10, 33.7°, 36.2°, 42.2°, 42.4°, and 53.3°, corresponding to the Miller indices (011), (−102), (−202), (−212), (210), and (−213) planes, respectively. These peaks aligned with the standard JCPD card (No. 00-009-0142), indicating the formation of $VO_2$ in the monoclinic phase. The NiO phase, indicated by the (*) symbol, was characterized by peaks at 2θ° values of 37.3°, 43.4°, 63.1°, and 75.6°, which corresponded to the Miller indices (111), (200), (220), and (311) planes, respectively, as per JCPD card (No. 01-073-1519). The crystalline phases of $Fe_2O_3$ and $VO_2$ shared some common reflection at 2θ° angles of 33.7° and 36.2°. Overall, the XRD analysis revealed the formation of a ternary-phase $Fe_2O_3$—NiO—$VO_2$ composite. The intensity of the crystalline peaks improved with increasing sintering time from 1 h to 3 h.

Figure 3A:
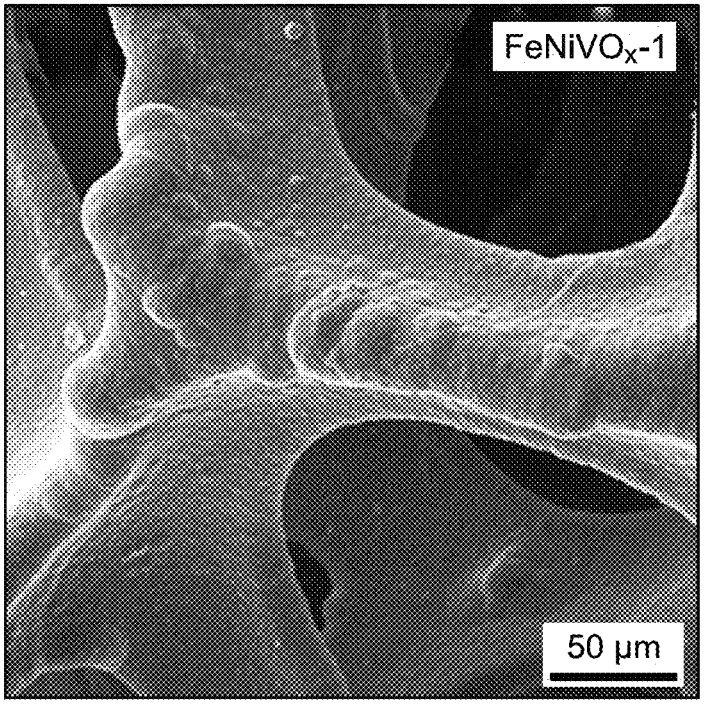
FIG. 3A shows a field-emission scanning electron microscopy (FESEM) image of trimetallic $FeNiVO_x$-1 composite catalyst deposited on NF for 1 h at a magnification scale of 50 micrometers (μm), according to certain embodiments.
Figure 3B:
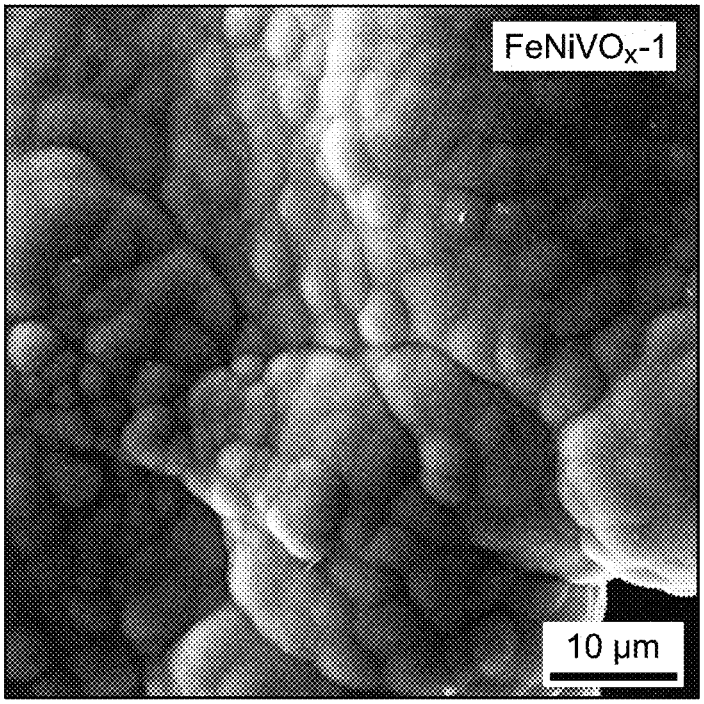
FIG. 3B shows an FESEM image of trimetallic $FeNiVO_x$-2 composite catalyst deposited on NF for 2 h at a magnification scale of 50 μm, according to certain embodiments.
Figure 3C:
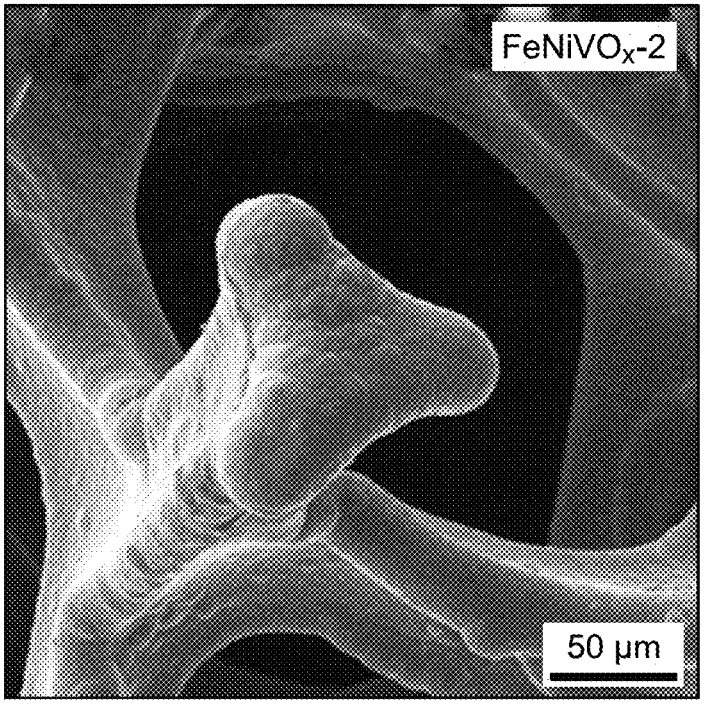
FIG. 3C shows an FESEM image of trimetallic $FeNiVO_x$-3 composite catalyst deposited on NF for 3 h at a magnification scale of 50 μm, according to certain embodiments.
Figure 3D:
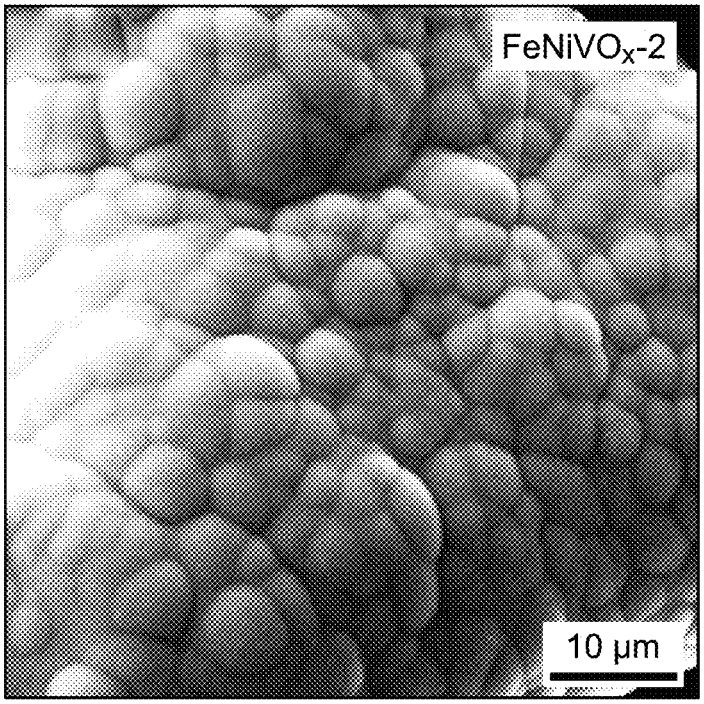
FIG. 3D shows an FESEM image of trimetallic $FeNiVO_x$-1 composite catalyst deposited on NF for 1 h at a magnification scale of 10 μm, according to certain embodiments.
Figure 3E:
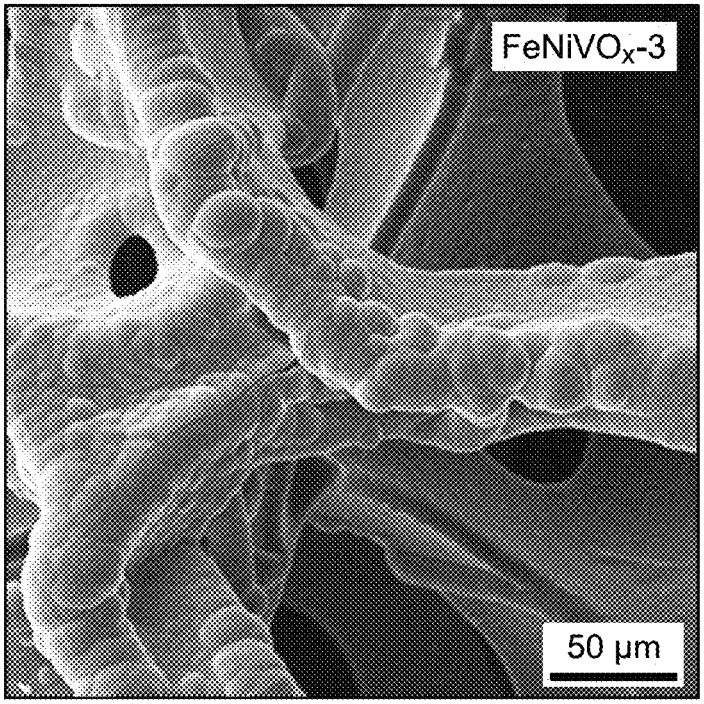
FIG. 3E shows an FESEM image of trimetallic $FeNiVO_x$-2 composite catalyst deposited on NF for 2 h at a magnification scale of 10 μm, according to certain embodiments.
Figure 3F:
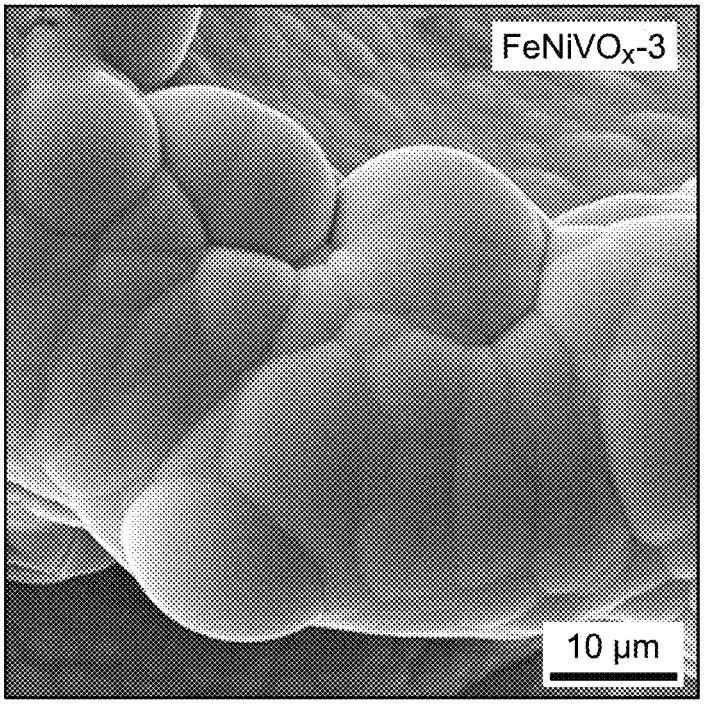
FIG. 3F shows an FESEM image of trimetallic $FeNiVO_x$-3 composite catalyst deposited on NF for 3 h at a magnification scale of 10 μm, according to certain embodiments.

Further, the FESEM micrographs of the ternary $FeNiVO_x$ composite catalyst developed on NF showed the effect of increasing deposition time from 1 h to 3 h. FIG. 3A-3C show FESEM images of trimetallic $FeNiVO_x$ composite catalyst deposited on NF for 1, 2, and 3 h at a magnification scale of 50 μm. FIG. 3D-3F show FESEM images of trimetallic $FeNiVO_x$ composite catalyst deposited on NF for 1, 2, and 3 h at a magnification scale of 10 μm. In each case, NF scaffold was deposited with uniform layer of composite material, as shown in FIGS. 3A, 3C and 3E. Notably, the catalyst material distributed along the contours of NF without blocking its porous tunnel and three-dimensional structure. After the first hour of deposition, spherical buds appeared on the NF surface, as shown in FIGS. 3A and 3D, indicating the growth of trimetallic composite material. Spherical buds grow larger with a sintering time of 2 h, resulting in improved grain boundaries and more compact and dense spherical features, as shown in FIGS. 3B and 3E. Extending the deposition process to 3 h results in a substantial coating of the NF with the deposited catalyst, as shown in FIGS. 3C and 3F, and an increase in the size of the spherical objects observed, as shown in FIG. 3F. Particularly, the resultant morphological features adhered well to the NF surface and were produced through a single-step AACVD process without using any template or binding material. Additionally, self-assembled and well-dispersed catalytic active sites over NF enhanced OER activity. Increasing the deposition time from 1 h to 3 h increased the catalyst mass deposited from 0.095 mg to 0.340 mg. This increase of the catalyst amount contributed to achieving enhanced OER performance.

Figure 4A:
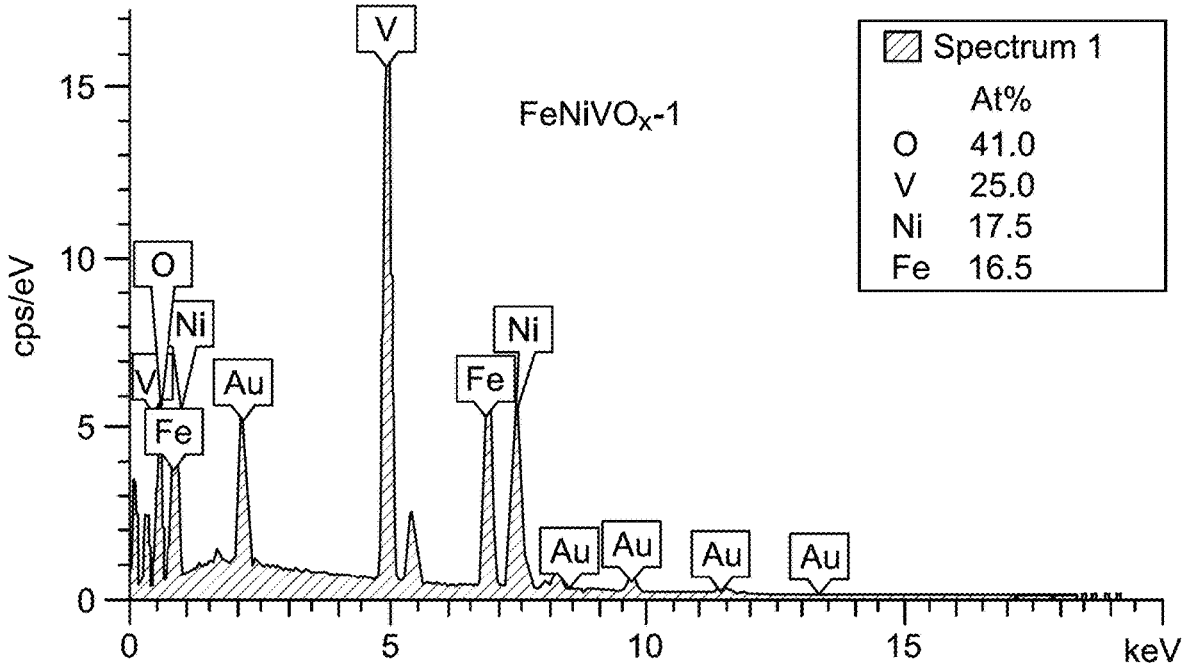
FIG. 4A shows an energy-dispersive X-ray spectroscopy (EDX) spectra of the trimetallic $FeNiVO_x$-1 catalyst, depicting the atomic concentrations of oxygen (O), vanadium (V), nickel (Ni), and iron (Fe), according to certain embodiments.
Figure 4B:
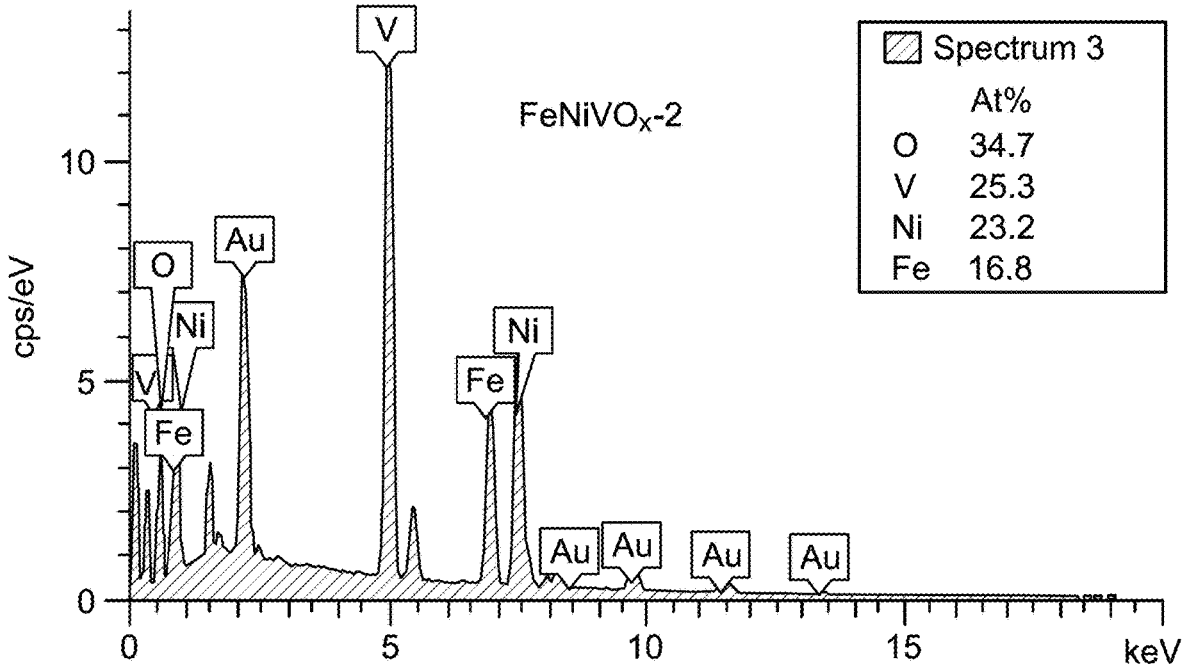
FIG. 4B shows an EDX spectra of the trimetallic $FeNiVO_x$-2 catalyst, depicting the atomic concentrations of O, V, Ni, and Fe, according to certain embodiments.
Figure 4C:
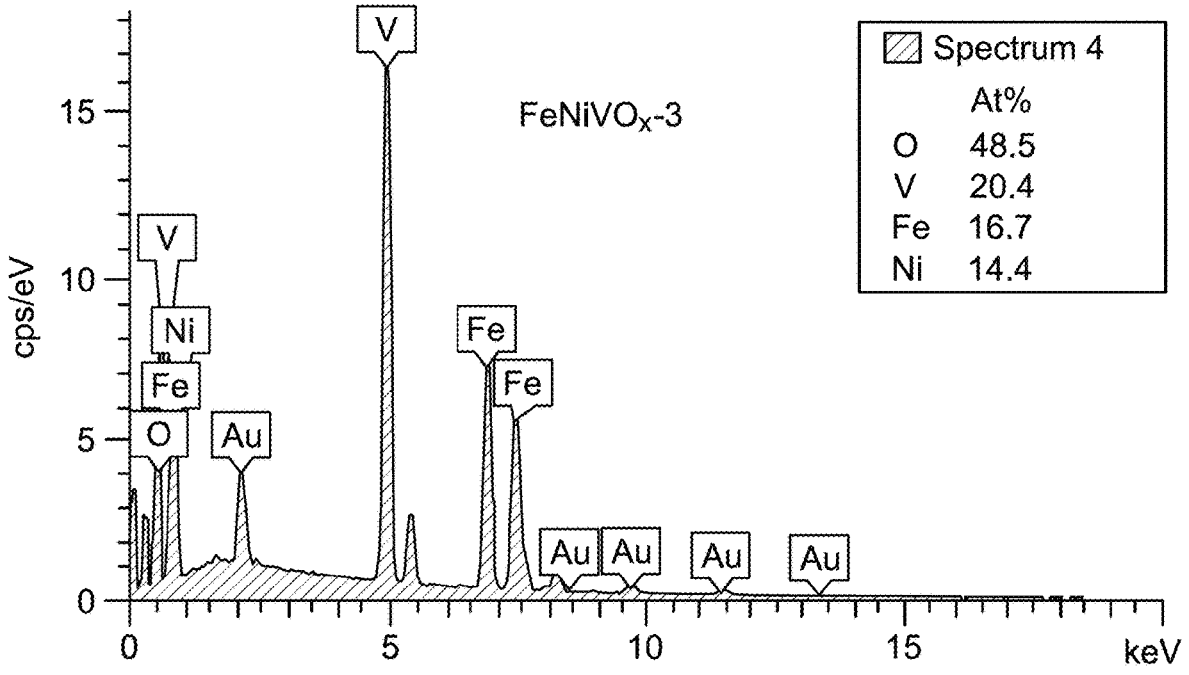
FIG. 4C shows an EDX spectra of the trimetallic $FeNiVO_x$-3 catalyst, depicting the atomic concentrations of O, V, Ni, and Fe, according to certain embodiments.
Figure 5A:
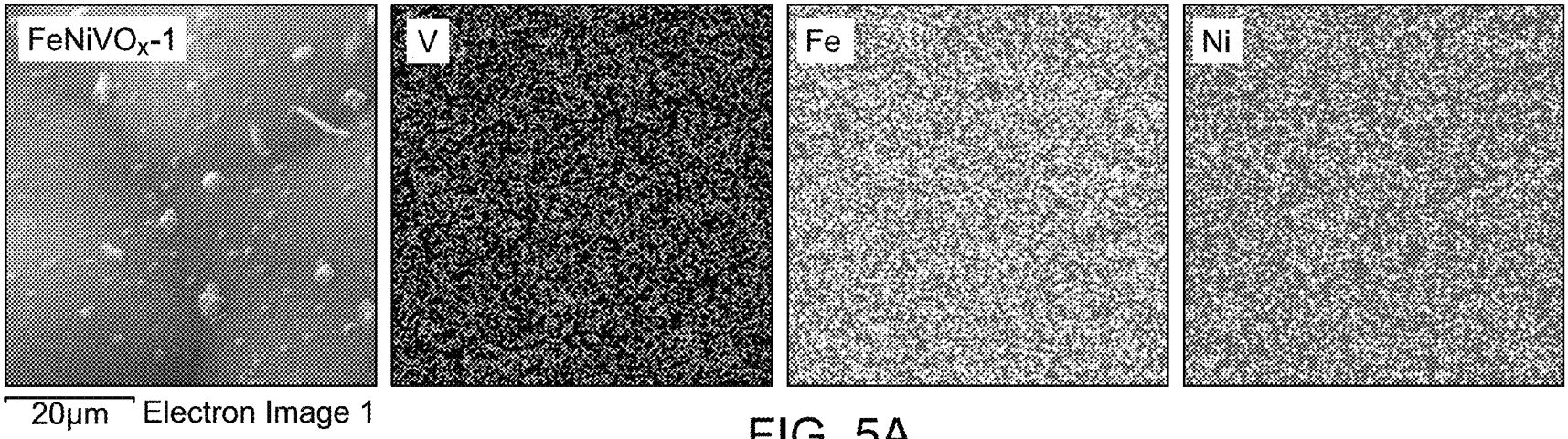
FIG. 5A shows a SEM micrograph and corresponding EDX mapping analysis of trimetallic $FeNiVO_x$-1 composite catalyst including V, Fe and Ni elements, according to certain embodiments.
Figure 5B:
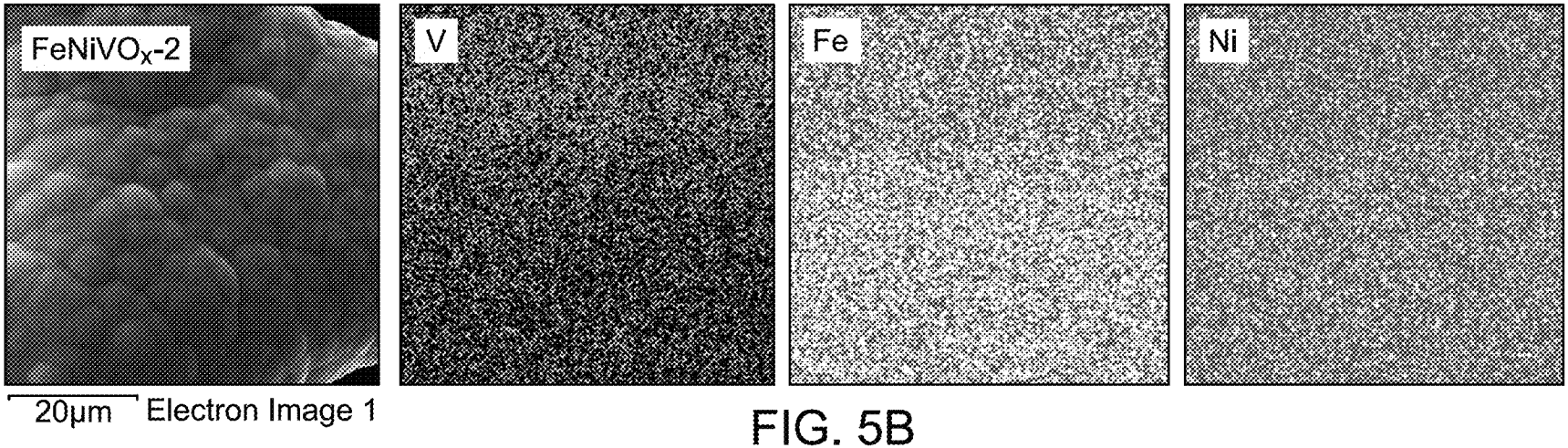
FIG. 5B shows a SEM micrograph and corresponding EDX mapping analysis of trimetallic $FeNiVO_x$-2 composite catalyst including V, Fe and Ni elements, according to certain embodiments.
Figure 5C:
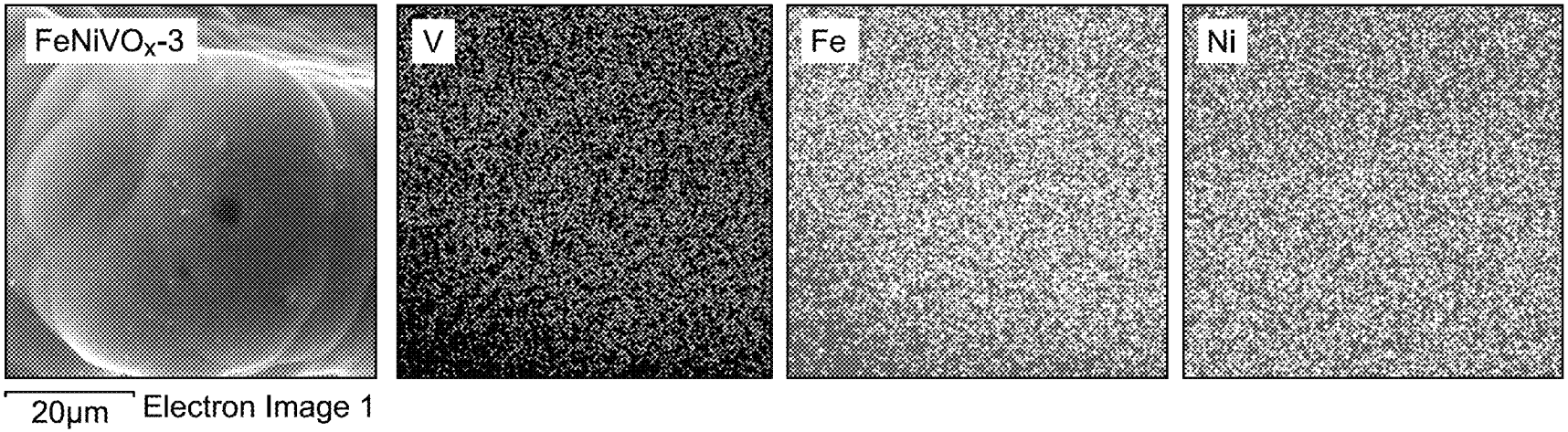
FIG. 5C shows a SEM micrograph and corresponding EDX mapping analysis of trimetallic $FeNiVO_x$-3 composite catalyst including V, Fe and Ni elements, according to certain embodiments.

Further, the elemental composition of the trimetallic $FeNiVO_x$ composite was evaluated using EDX analysis. For accuracy, samples prepared on plain glass were examined, as measurements from samples fabricated on NF might be inaccurate due to the presence of elemental nickel. The resultant EDX spectra, along with the measured atomic percentages for $FeNiVO_x$-1, $FeNiVO_x$-2, and $FeNiVO_x$-3, is shown in FIGS. 4A-4C, respectively. The sample deposited for 1 h included iron (Fe), nickel (Ni), and vanadium (V) at atomic percentages of 16 atomic percent (at. %), 17 at. %, and 25 at. %, respectively, corresponding to an empirical atomic ratio of 1:1:1.5. This empirical ratio was consistent across the other two variants deposited for 2 h and 3 h. Additionally, the EDX map analysis confirmed that Fe, Ni, and V elements were evenly distributed throughout all trimetallic composite oxide samples $FeNiVO_x$-1, $FeNiVO_x$-2, and $FeNiVO_x$-3, as shown in FIGS. 5A-5C, respectively.

Figure 6A:
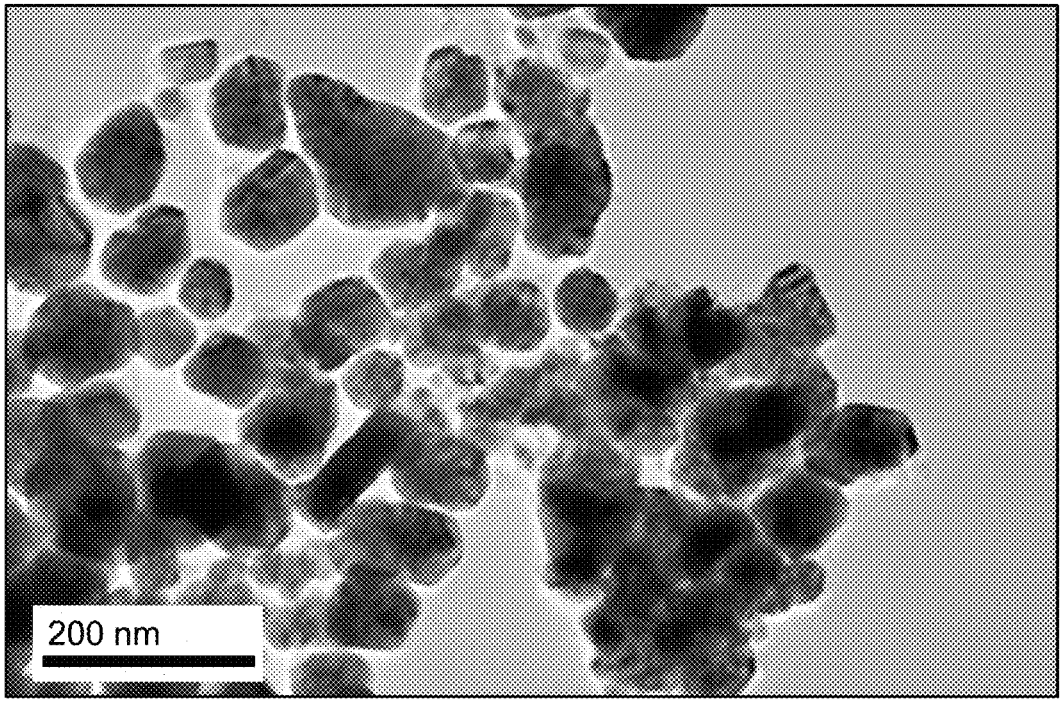
FIG. 6A shows a transmission electron microscopy (TEM) image of $FeNiVO_x$-3 catalyst at a magnification scale of 200 nanometers (nm), according to certain embodiments.
Figure 6B:
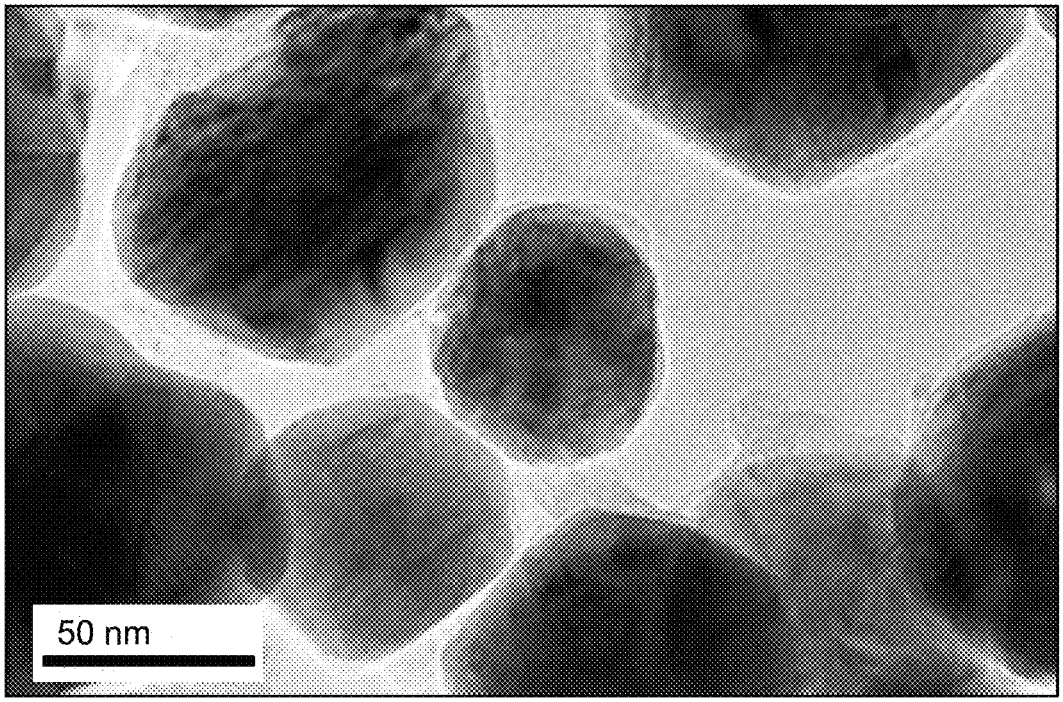
FIG. 6B shows a TEM image of $FeNiVO_x$-3 catalyst at a magnification scale of 50 nm, according to certain embodiments.
Figure 6C:
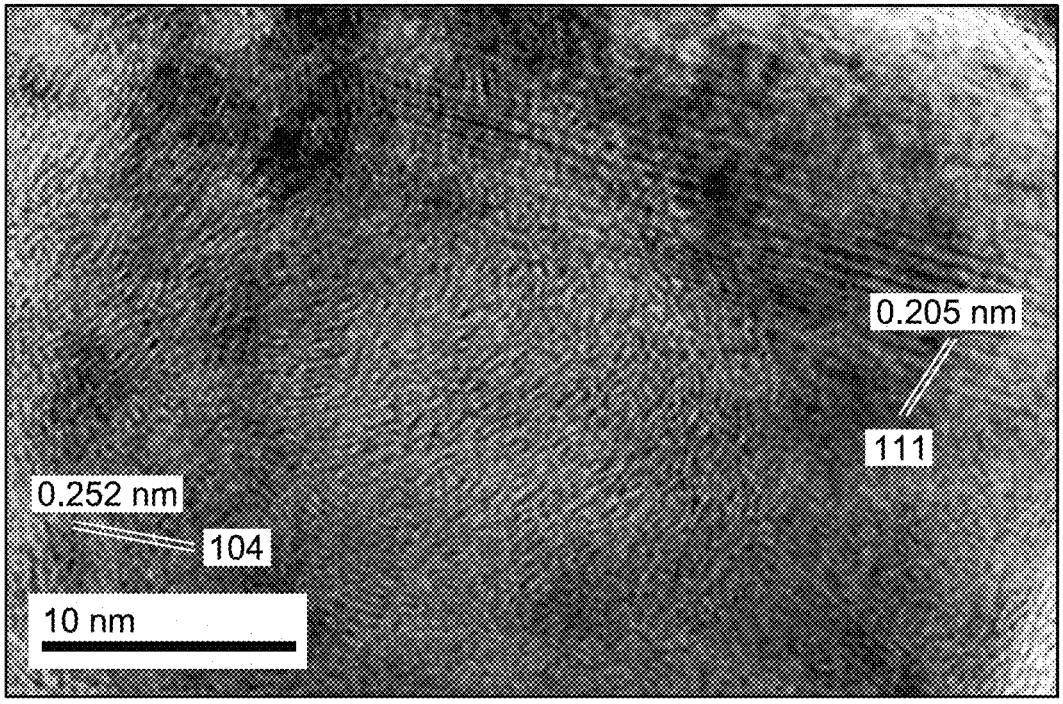
FIG. 6C shows high resolution transmission electron microscopy (HR-TEM) image depicting lattice fringe pattern at a magnification scale of 10 nm, according to certain embodiments.
Figure 6D:
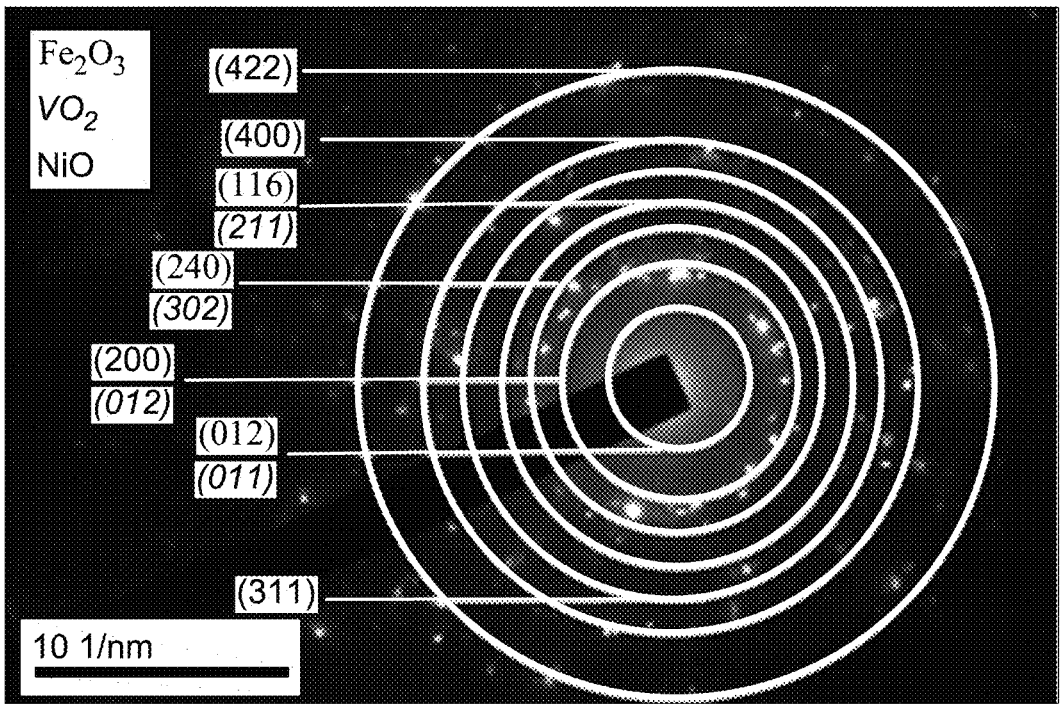
FIG. 6D shows a selected area electron diffraction (SAED) pattern labelled with reflections planes of multiple phases of ferric oxide ($Fe_2O_3$), nickel oxide (NiO) and vanadium dioxide ($VO_2$), according to certain embodiments.

Further structural analysis of the trimetallic composite $FeNiVO_x$-3h catalyst was conducted using TEM, as presented in FIGS. 6A-6D. FIG. 6A shows a TEM image of $FeNiVO_x$-3 catalyst at a magnification scale of 200 nanometers (nm). FIG. 6B shows a TEM image of $FeNiVO_x$-3 catalyst at a magnification scale of 50 nm. TEM images at low resolution revealed several agglomerated nano-spherical particles, exhibiting morphological resemblance to the FESEM results. FIG. 6C shows a high resolution transmission electron microscopy (HR-TEM) image depicting lattice fringe pattern at a magnification scale of 10 nm. At high resolution, the discernible lattice fringe pattern indicated the crystalline nature of the $FeNiVO_x$ material. The inter-planar distances (d-spacing) measured from the nanocrystallite surface were 0.252 nm and 0.205 nm, respectively. These measured d-spacing values closely corresponded to the d-spacing of 0.26 nm for the (200) plane of $Fe_2O_3$, 0.208 nm for the (200) plane of NiO, and 0.20 nm for the (021) plane of $VO_2$ phases. The selected area electron diffraction (SAED) pattern (FIG. 6D), in the form of multiple rings, suggested the polycrystalline nature of the trimetallic catalyst, with each diffraction ring representing a crystal plane of different $Fe_2O_3$, NiO, and $VO_2$ phases.

Figure 7A:
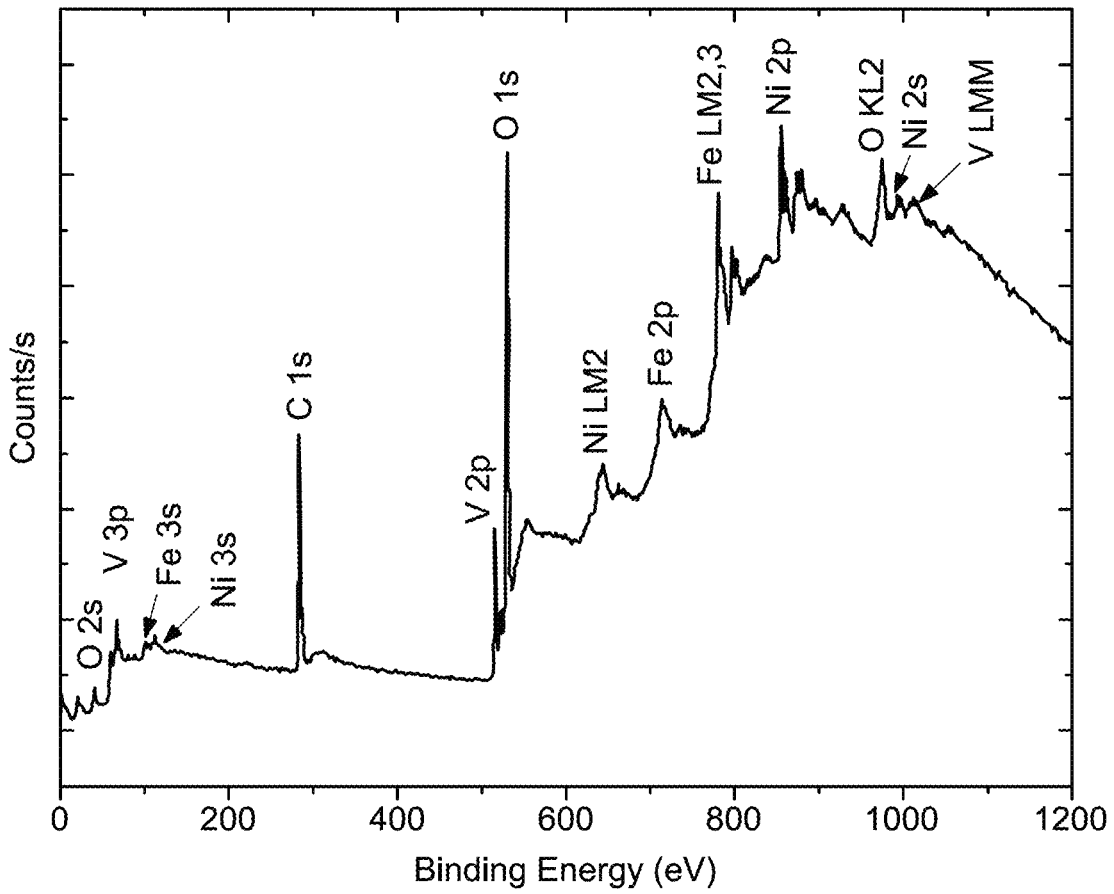
FIG. 7A is an X-ray photoelectron spectroscopy (XPS) survey scan spectrum of the $FeNiVO_x$ catalyst, according to certain embodiments.
Figure 7B:
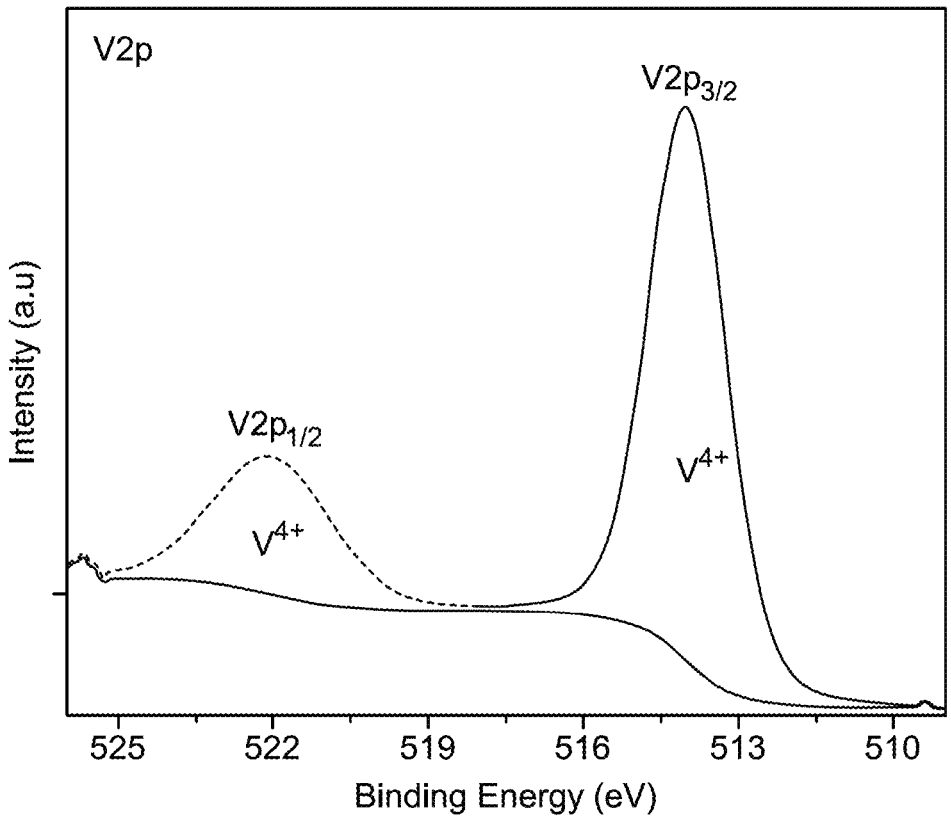
FIG. 7B is an XPS analysis of the V 2p spectrum for the $FeNiVO_x$-3h catalyst, according to certain embodiments.
Figure 7C:
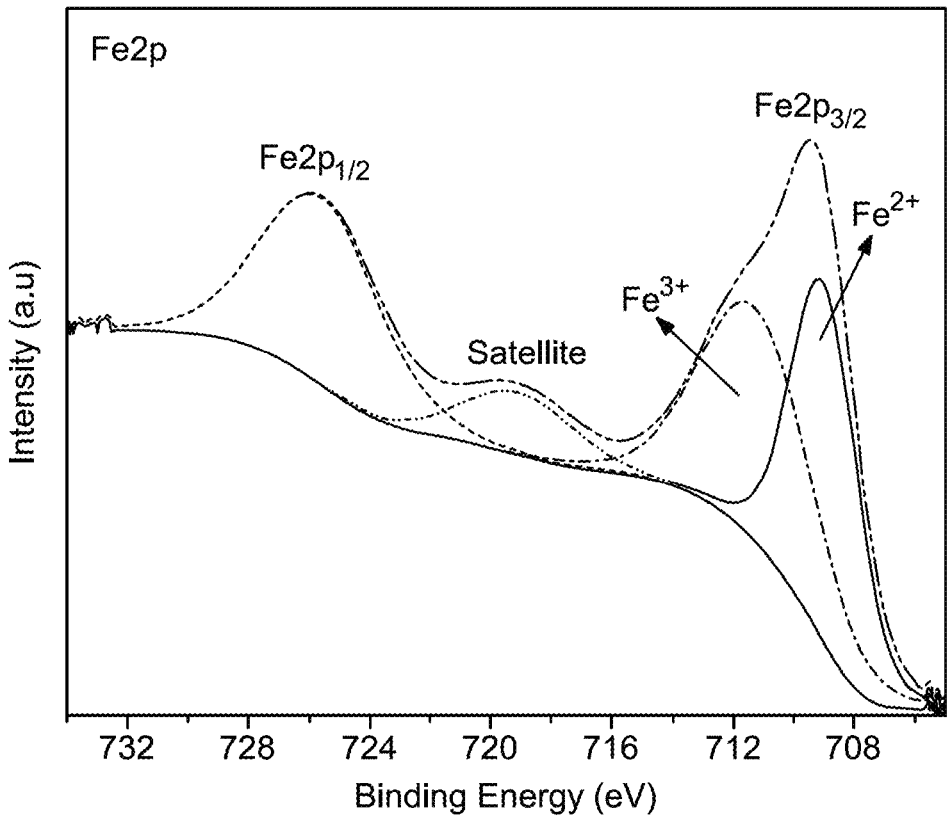
FIG. 7C is an XPS analysis of the Fe 2p spectrum for the $FeNiVO_x$-3h catalyst, according to certain embodiments.
Figure 7D:
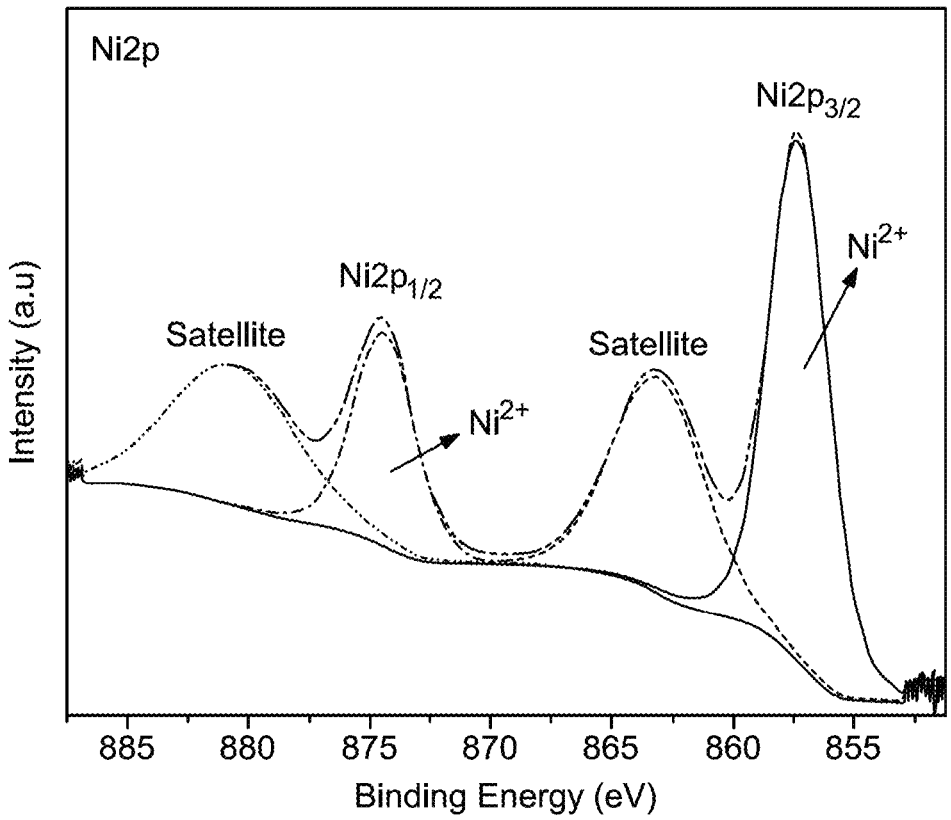
FIG. 7D is an XPS analysis of the Ni 2p spectrum for the $FeNiVO_x$-3h catalyst, according to certain embodiments.
Figure 7E:
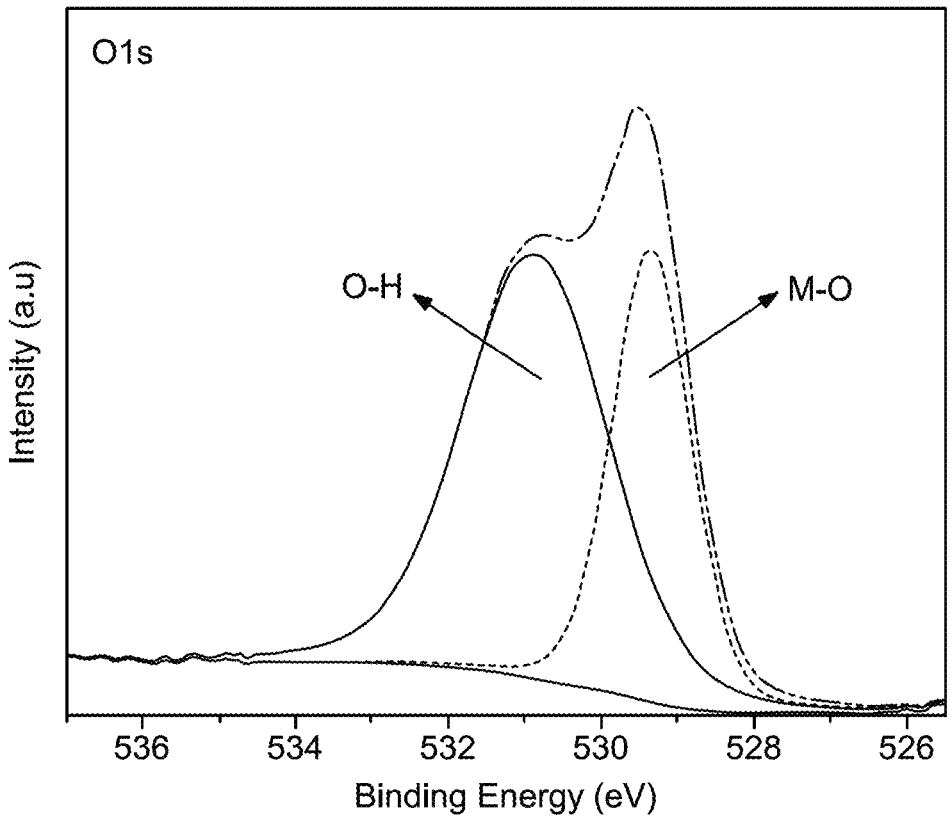
FIG. 7E is an XPS analysis of the O 1s spectrum for the $FeNiVO_x$-3h catalyst, according to certain embodiments.

The trimetallic $FeNiVO_x$ sample, fabricated on a glass substrate over 3 h, was analyzed using XPS and results, as shown in FIG. 7A-7E. The survey scan spectrum confirmed the presence of all anticipated elements, Fe, Ni, V, and 0, as shown in FIG. 7A. High-resolution XPS scans were used to examine the oxidation states and electronic structure of these elements. As shown in FIG. 7B, the deconvoluted V 2p spectrum exhibited doublet peaks at binding energies of 514.1 electron volts (eV) and 522.1 eV, corresponding to V $2p_{3/2}$ and V $2p_{1/2}$ spin-orbits, indicative of the $V^{4+}$ oxidation state in the form of the $VO_2$ phase in the trimetallic composite sample. The Fe 2p spectrum also exhibited typical doublet bands associated with Fe $2p_{3/2}$ and Fe $2p_{1/2}$ peaks, further split into four peaks representing $Fe^{2+}$ at 709.3 eV and 726.0 eV and $Fe^{3+}$ at 711.6 eV and 725.9 eV ions, as shown in FIG. 7C. Additionally, weak satellite peaks at 719.5 eV and 732.6 eV suggested the presence of the hematite ($Fe_2O_3$) phase. The Ni 2p spectrum displayed two spin-orbit doublets at 857.3 eV and 874.4 eV, corresponding to Ni $2p_{3/2}$ and Ni $2p_{1/2}$, along with characteristic satellite peaks at 862.9 and 880.8 eV, consistent with the $Ni^{2+}$ state in the form of NiO, as shown in FIG. 7D. The O 1s profile revealed two distinct oxygen peaks, indicating the presence of two types of oxygen atoms, as shown in FIG. 7E. The peak at 529.6 eV corresponded to oxygen atoms directly bonded to the metal (M-O), while the peak at 530.9 eV suggested the presence of hydroxide (O—H) species adsorbed on the catalyst surface.

Figure 8A:
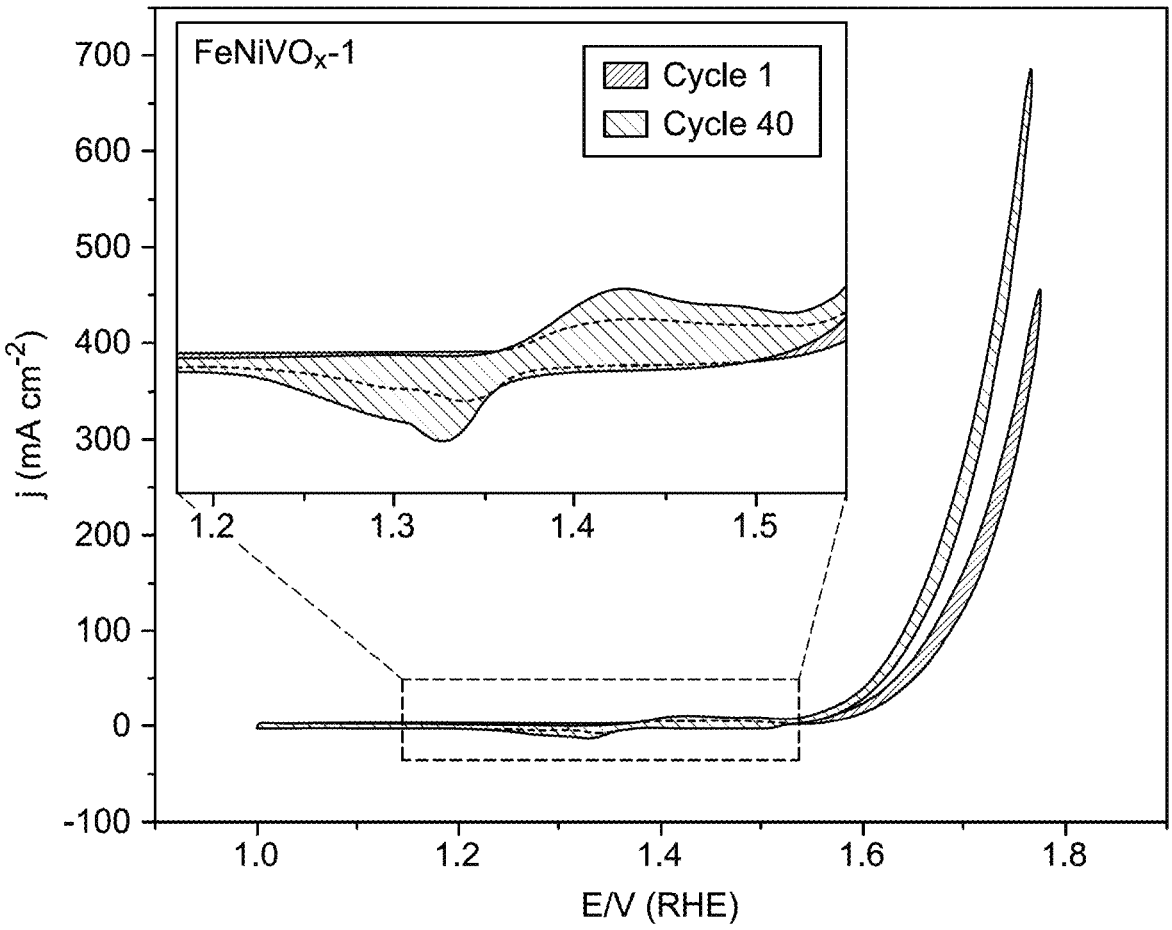
FIG. 8A shows a cyclic voltammogram (CV) curve of $FeNiVO_x$-1 trimetallic catalyst performed at scan rate of 50 millivolts per second ($mVs^{-1}$) in 1.0 KOH electrolyte for 1 h, with the inset showing a magnified view of the redox peaks corresponding to $FeNiVO_x$-1 catalyst, according to certain embodiments.
Figure 8B:
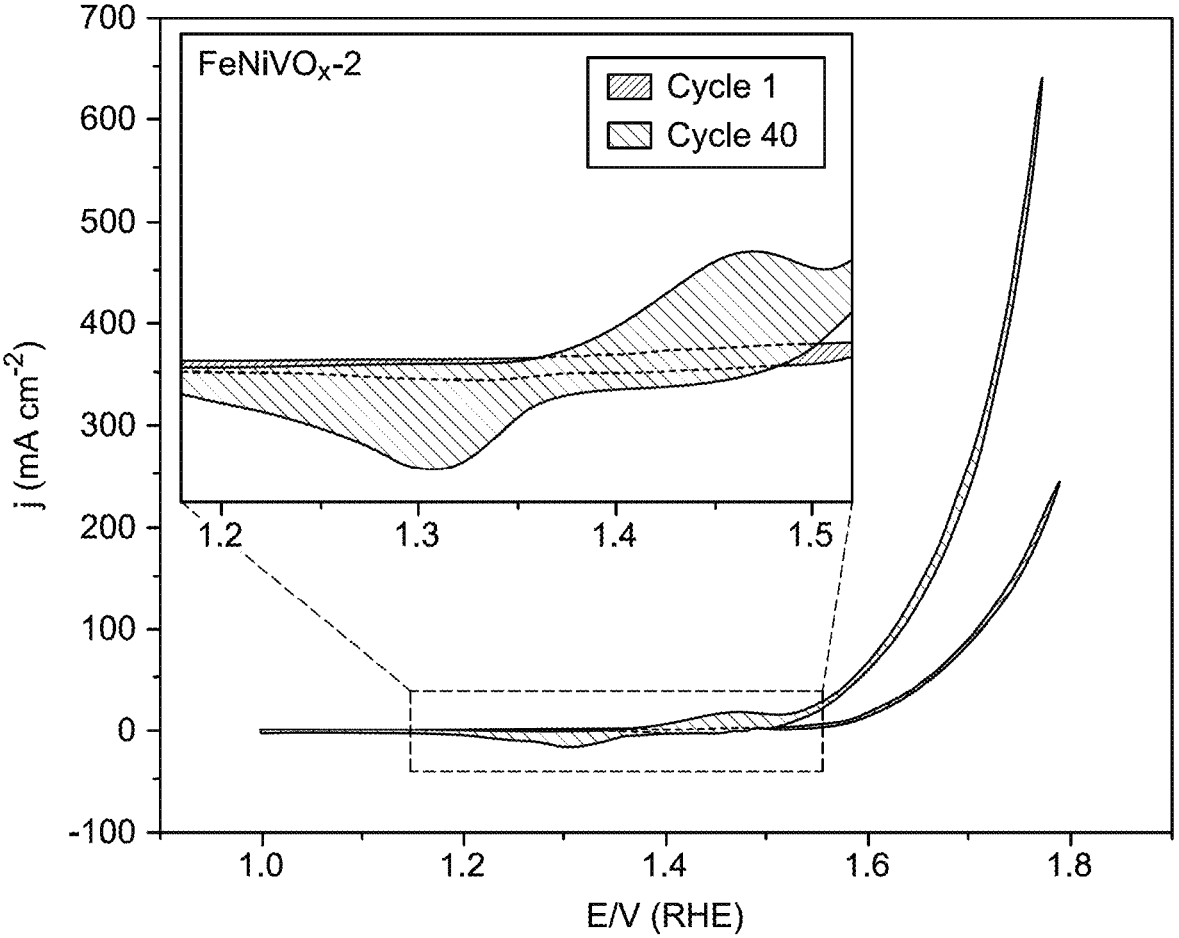
FIG. 8B shows a CV curve of $FeNiVO_x$-2 trimetallic catalyst performed at scan rate of 50 $mVs^{-1}$ in 1.0 KOH electrolyte for 2 h, with the inset showing a magnified view of the redox peaks corresponding to $FeNiVO_x$-2 catalyst, according to certain embodiments.
Figure 8C:
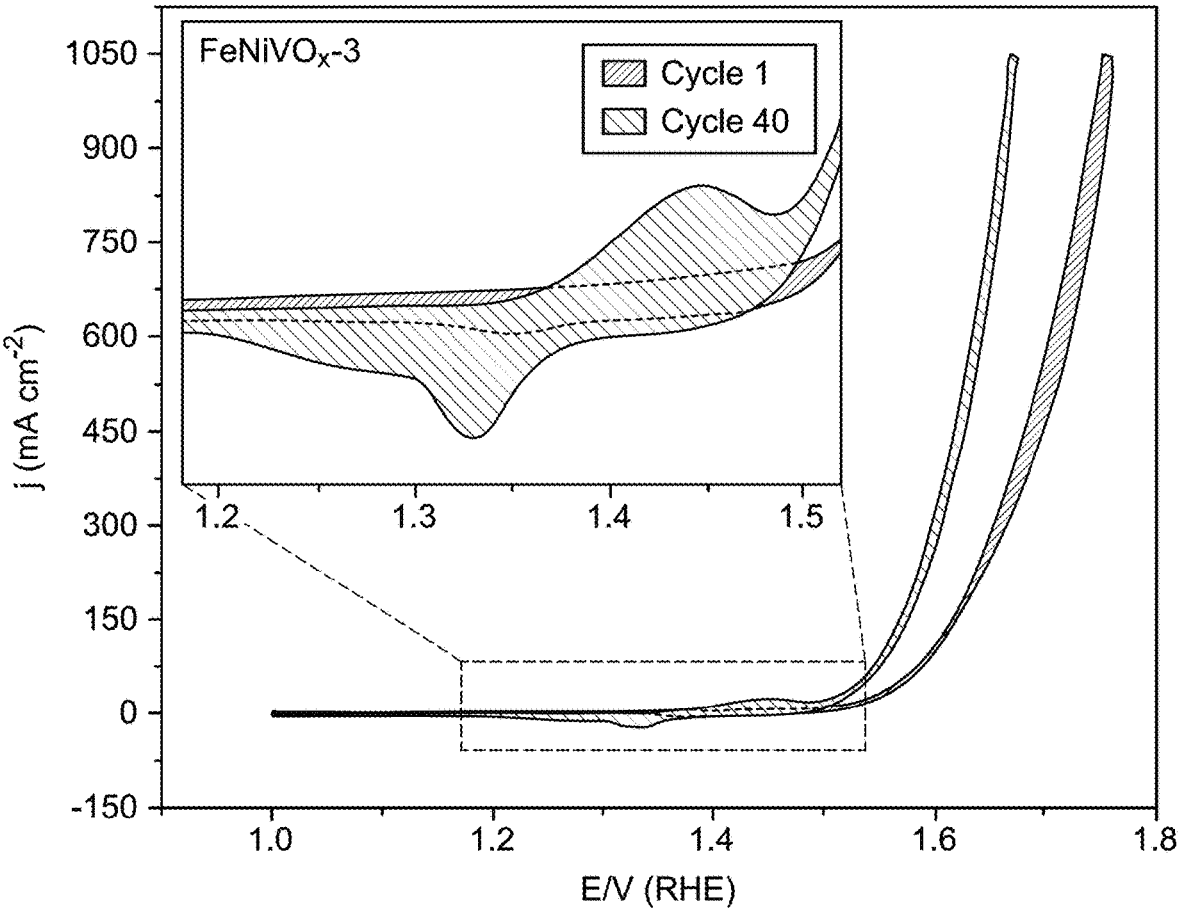
FIG. 8C shows a CV curve of $FeNiVO_x$-3 trimetallic catalyst performed at scan rate of 50 $mVs^{-1}$ in 1.0 KOH electrolyte for 3 h, with the inset showing a magnified view of the redox peaks corresponding to $FeNiVO_x$-3 catalyst, according to certain embodiments.
Figure 8D:
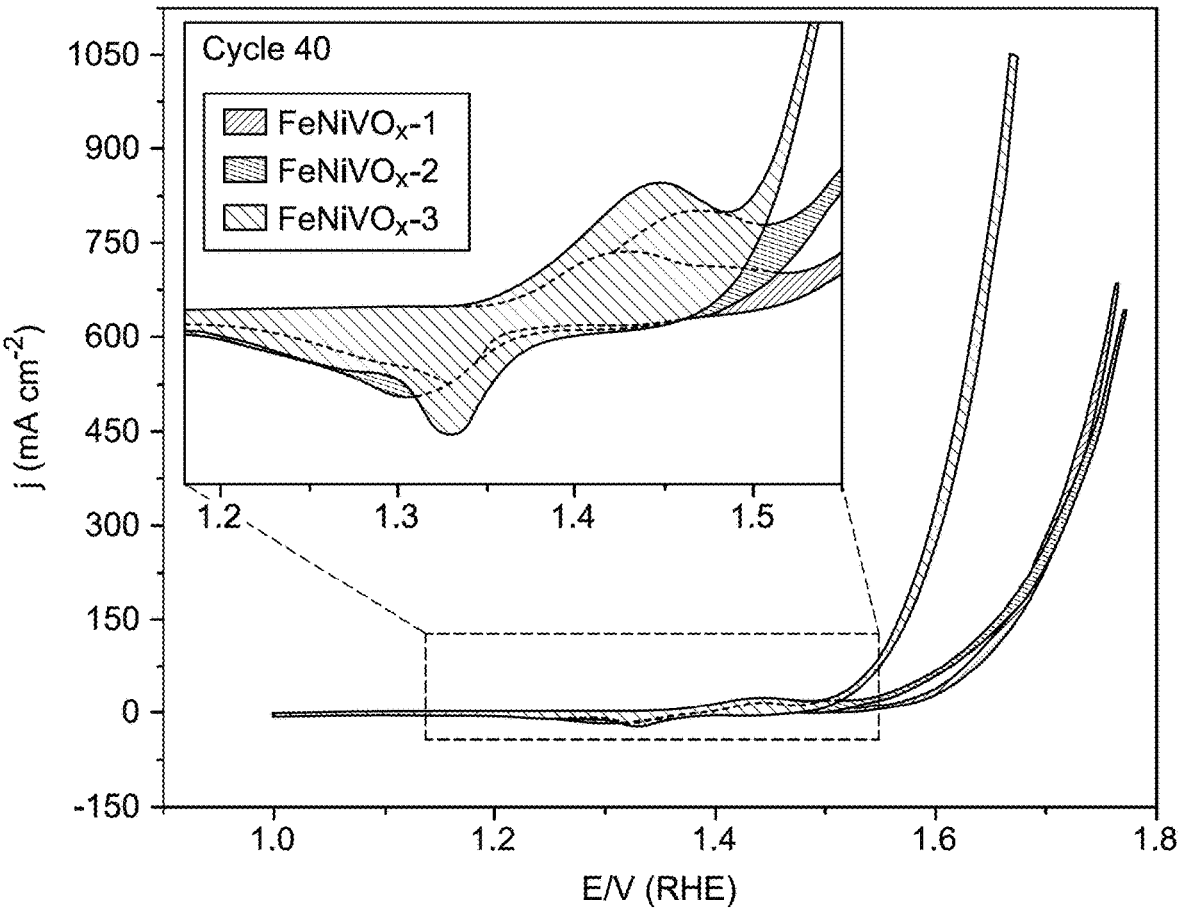
FIG. 8D shows a comparative $40^{th}$ CV curve of the trimetallic $FeNiVO_x$-1, $FeNiVO_x$-2 and $FeNiVO_x$-3 catalysts, with the inset showing a magnified view of the redox peaks corresponding to each catalyst sample, according to certain embodiments.

The OER performance of the as synthesized trimetallic $FeNiVO_x$ composite electrodes was evaluated through a series of electrochemical experiments conducted in a 1.0 M KOH electrolyte. FIG. 8A shows a CV curve of $FeNiVO_x$-1 trimetallic catalyst performed at a scan rate of 50 $mVs^{-1}$ in 1.0 KOH electrolyte for 1 h, with the inset showing a magnified view of the redox peaks corresponding to $FeNiVO_x$-1 catalyst. Initially, CV tests were performed to activate the catalyst surfaces, with the CV profiles of trimetallic catalysts after undergoing forty (40) continuous cycles, as shown in FIGS. 8A-8D. FIG. 8B shows a CV curve of $FeNiVO_x$-2 trimetallic catalyst performed at a scan rate of 50 $mVs^{-1}$ in 1.0 KOH electrolyte for 2 h, with the inset showing a magnified view of the redox peaks corresponding to $FeNiVO_x$-2 catalyst. FIG. 8C shows a CV curve of $FeNiVO_x$-3 trimetallic catalyst performed at a scan rate of 50 $mVs^{-1}$ in 1.0 KOH electrolyte for 3 h, with the inset showing a magnified view of the redox peaks corresponding to $FeNiVO_x$-3 catalyst. Interestingly, the overpotential and peak current density values improved from the $1^{st}$ to the $40^{th}$ CV cycle, attributed to the catalyst activation from CV treatment. This activation was indicated by the appearance of redox peaks in the region of 1.3 V-1.5 V (vs RHE), as shown in the insets of FIGS. 8A-8D. In each case, the redox peak area associated with the $40^{th}$ CV cycle was larger than that of the $1^{st}$ CV cycle. FIG. 8D shows a comparative $40^{th}$ CV curve of the trimetallic $FeNiVO_x$-1, $FeNiVO_x$-2 and $FeNiVO_x$-3 catalysts, with the inset showing a magnified view of the redox peaks corresponding to each catalyst sample. The larger redox peak area signified the formation of numerous catalytic species in the form of high-valent metal ions such as $M^{3+}/M^{4+}$ etc., which performed the oxidation process more efficiently than the parent metal ions, as shown in FIG. 8D.

Further, the redox peak area of the $FeNiVO_x$-3 catalyst was found to be larger than its other two variants $FeNiVO_x$-1 and $FeNiVO_x$-2, suggesting that more active species were formed on the surface, which expedited the oxidation process more effectively than the other catalysts. The trimetallic catalytic systems, consisting of 3d metals including Fe, Ni, and V, were known for transferring into high-valent hydroxide/oxyhydroxide species ($Fe(OH)_3$/FeOOH, $Ni(OH)_3$/NiOOH, and $V(OH)_4$/VOOOH) in an alkaline electrolyte. These high-valent species acted as powerful oxidizing agents, facilitating the breaking of hydroxyl (O—H) bonds in water molecules. This process accelerated the release of oxygen molecules at higher rates, thereby enhancing the catalytic OER activity of the catalysts.

Figure 9A:
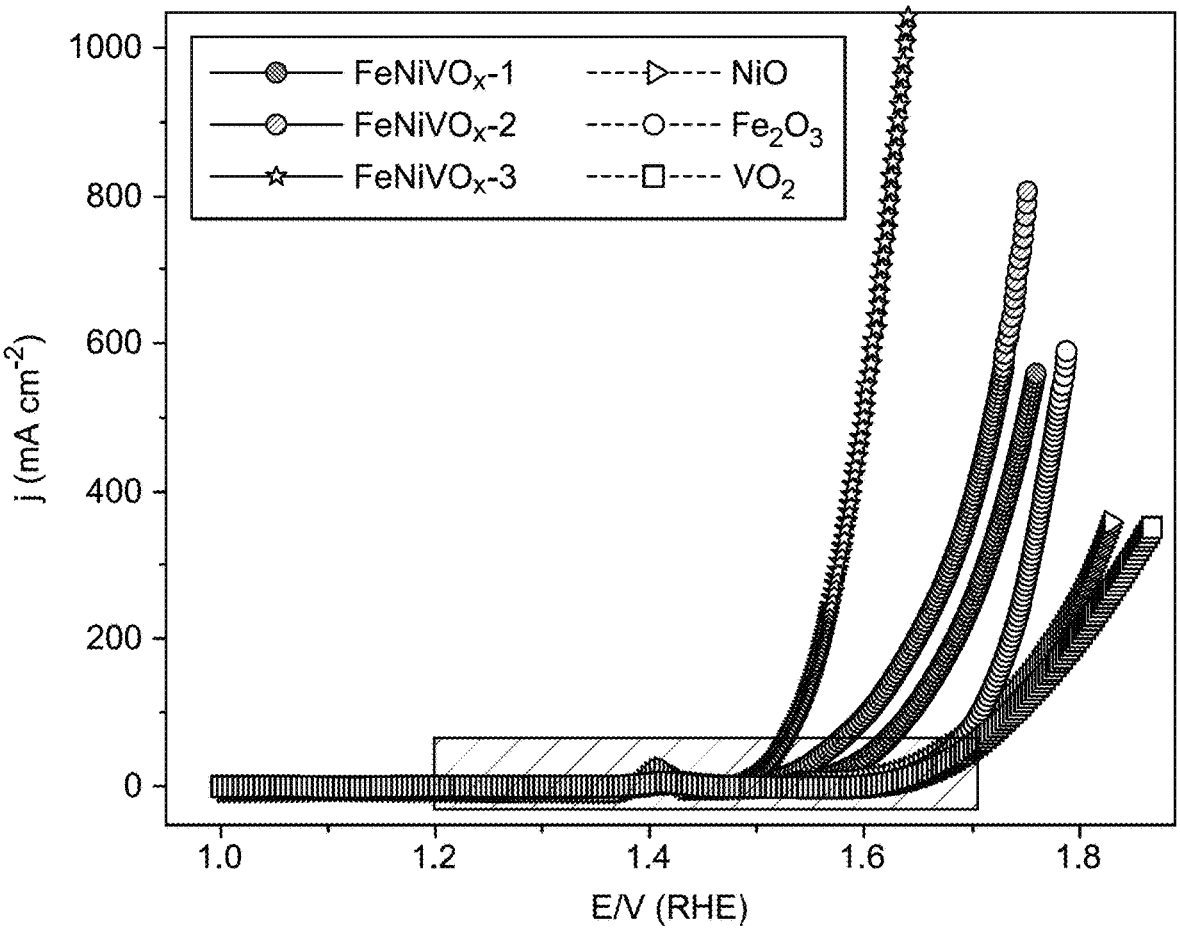
FIG. 9A shows the linear sweep voltammetry (LSV) curves of the monometallic $Fe_2O_3$, NiO, and $VO_2$ catalysts and trimetallic $FeNiVO_x$-1, $FeNiVO_x$-2 and $FeNiVO_x$-3 catalysts, according to certain embodiments.
Figure 9B:
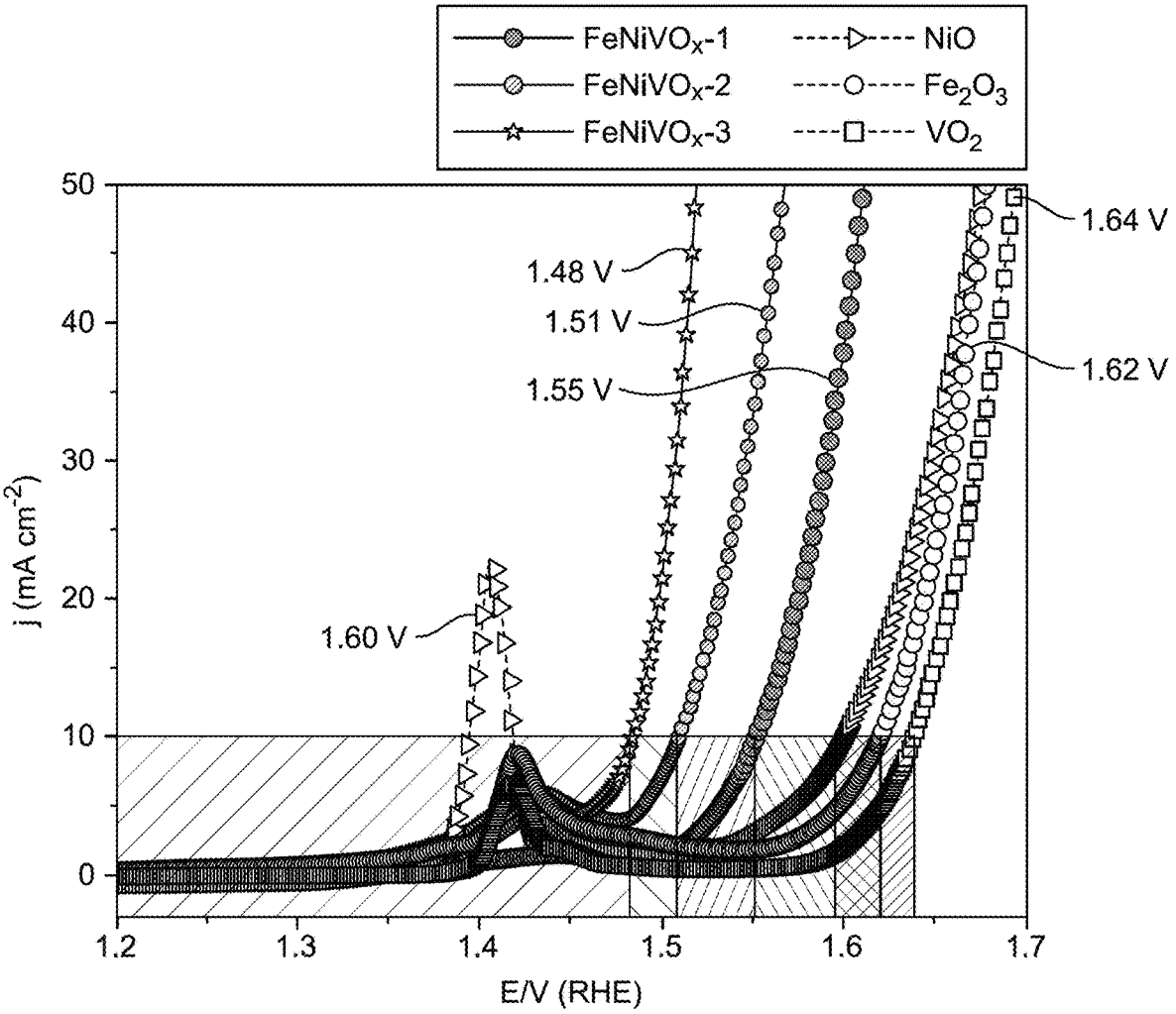
FIG. 9B shows a magnified view of the LSV curves for a clearer comparison between monometallic and trimetallic catalysts, according to certain embodiments.
Figure 9C:
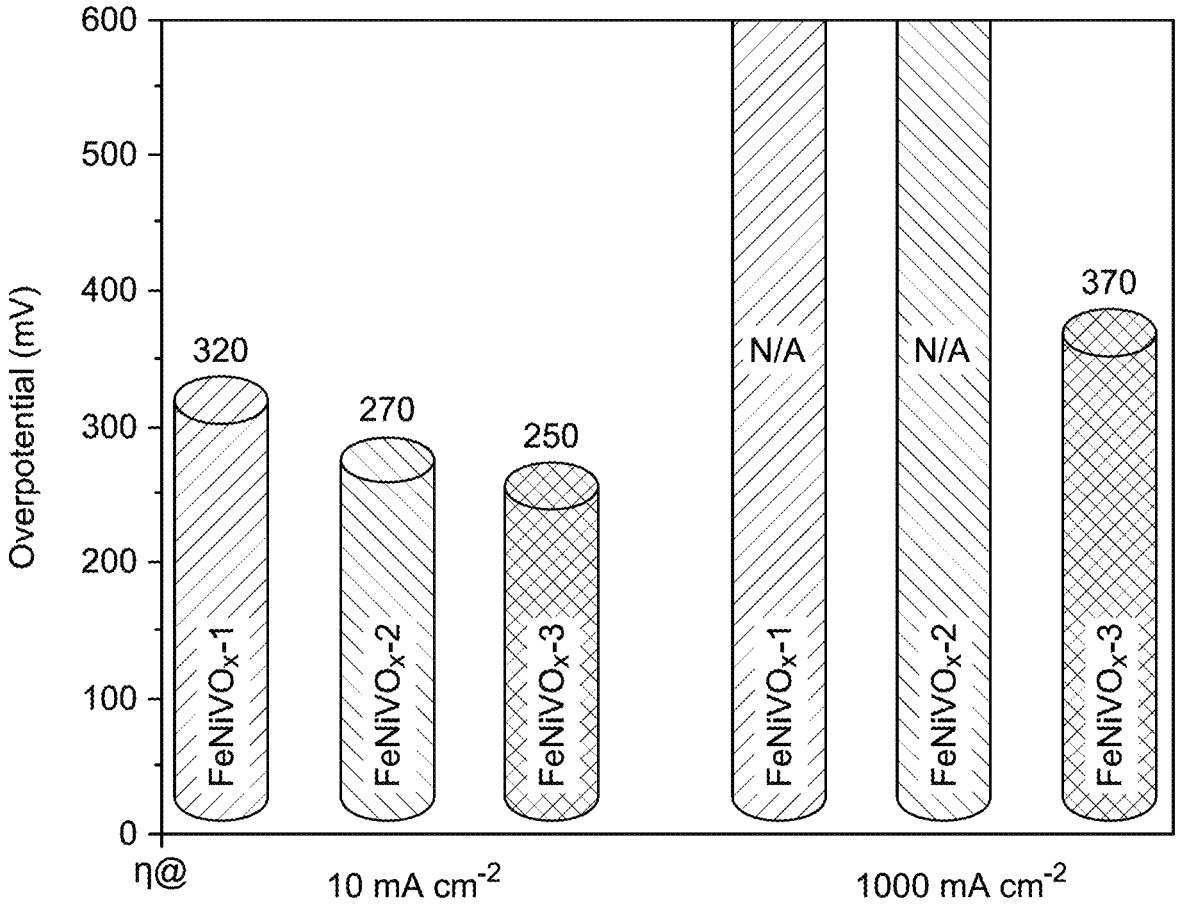
FIG. 9C depicts a comparison of overpotentials at different current densities for the monometallic $Fe_2O_3$, NiO, and $VO_2$ catalysts at 10 milliamperes per square centimeters ($mA\ cm^{-2}$) and trimetallic $FeNiVO_x$-1, $FeNiVO_x$-2 and $FeNiVO_x$-3 catalysts electrodes at 1000 $mA\ cm^{-2}$, according to certain embodiments.

Further, OER activity of the trimetallic $FeNiVO_x$ composite was evaluated through LSV measurements. To establish the improvements in OER performance of trimetallic catalysts, respective monometallic components including $Fe_2O_3$, NiO, and $VO_2$ catalysts were also subjected to LSV measurements. As shown in FIG. 9A, monometallic $Fe_2O_3$, NiO, and $VO_2$ electrodes require higher voltage to perform water oxidation compared to the trimetallic $FeNiVO_x$ electrodes. The improvements in overpotential requirements and peak current densities were attributed to the homogenous mixing and synergistic coupling among three metallic species (Fe—Ni—V) in composite catalysts, which enhanced the conductivity of the catalytic system. Among the three trimetallic $FeNiVO_x$ catalysts, the one deposited for 3 h exhibited remarkable OER activity, achieving a peak current density exceeding 1000 $mAcm^{-2}$ at a cell voltage of ~1.6 V vs reversible hydrogen electrode (RHE). In comparison, $FeNiVO_x$ catalysts deposited for 2 h and 1 h reached peak current densities of 800 $mAcm^{-2}$ and 525 $mAcm^{-2}$ at higher cell voltages of 1.73 V and 1.76 V vs RHE, respectively. To observe the differences in OER onset potential, a magnified view of the LSV curves is shown in FIG. 9B. For the trimetallic $FeNiVO_x$-3h catalyst, water oxidation begins at a low potential of 1.46 V vs RHE ($\eta_{onset}$, =230 mV), followed by $FeNiVO_x$-2h (1.49 V vs RHE, $\eta_{onset}$=260 mV) and $FeNiVO_x$-1h (1.51 V vs RHE, $\eta_{onset}$=280 mV). To reach the characteristic current density of 10 $mAcm^{-2}$, $FeNiVO_x$-3h required the least overpotential ($\eta_{10}$=250 mV) compared to $FeNiVO_x$-2h ($\eta_{10}$=270 mV) and $FeNiVO_x$-1h ($\eta_{10}$=320 mV), as shown in FIGS. 9B-9C.

Furthermore, the $FeNiVO_x$-3h catalyst generated an exceptionally high current density exceeding 1000 $mAcm^{-2}$ at an overpotential of just 370 millivolts (mV), a performance not matched by the other two $FeNiVO_x$ catalysts. The enhanced OER performance of the $FeNiVO_x$-3 h electrode compared to its two other variants may be attributed to its good crystallinity, abundant active sites, and the larger amount of catalyst produced by the continuous 3 h AACVD process. XRD results indicate that the three oxide phases exhibit better crystalline properties due to the appropriate sintering time of 3 h. CV results also showed the formation of a high quantity of redox species on the 3-h electrode surface. Additionally, the mass loading of 0.340 mg the catalyst, measured in milligrams, is a result of the three-h deposition process.

Figure 9D:
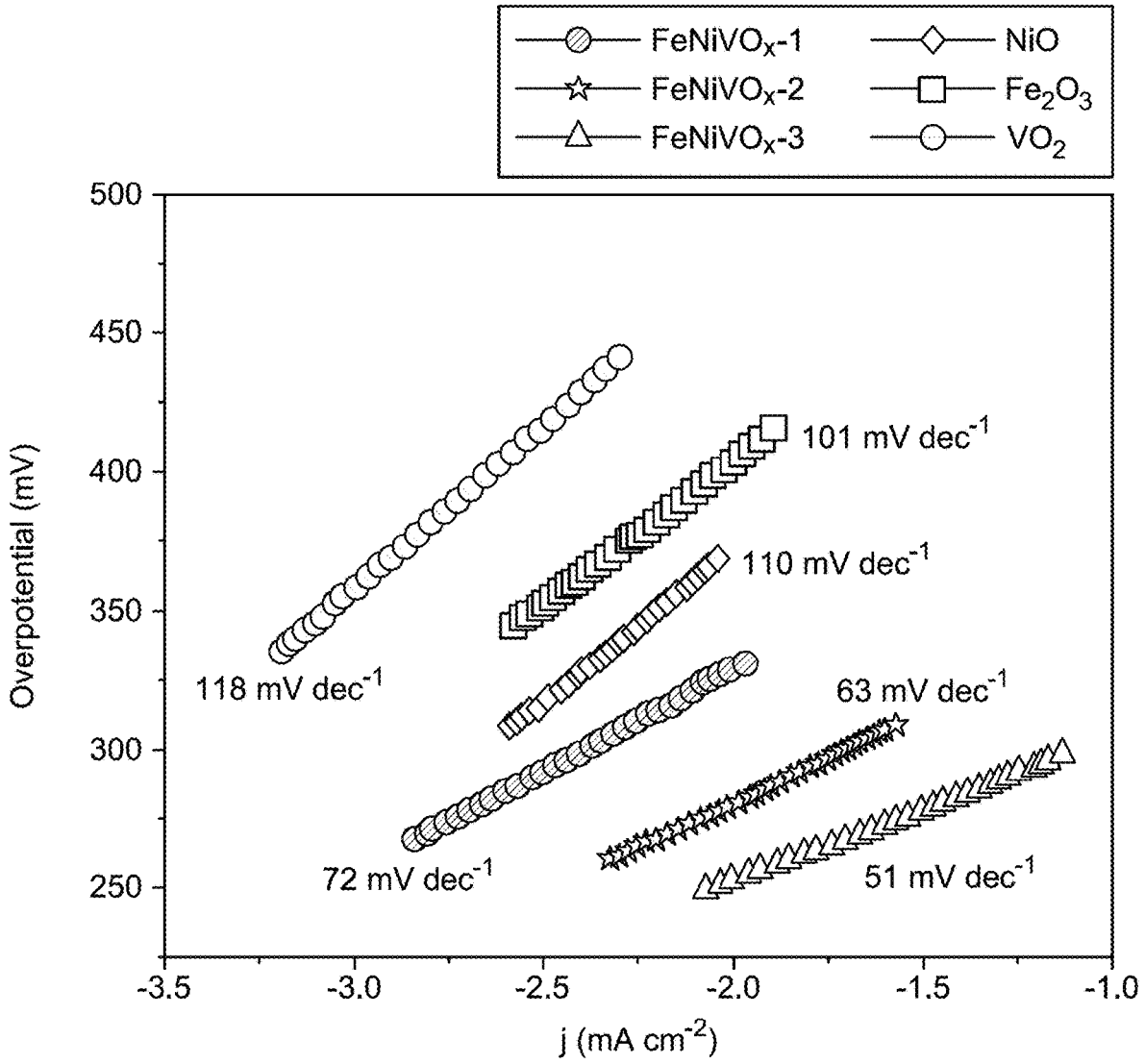
FIG. 9D shows the Tafel plots of monometallic $Fe_2O_3$, NiO, and $VO_2$ and trimetallic $FeNiVO_x$-1, $FeNiVO_x$-2 and $FeNiVO_x$-3 catalysts, according to certain embodiments.

OER kinetics of prepared catalysts were further evaluated by comparing $FeNiVO_x$ catalysts Tafel slope values extracted from the respective LSV curves, as shown in FIG. 9D. As anticipated, the $FeNiVO_x$-3h electrode exhibited the lowest Tafel slope value of 51 millivolts per decade ($mVdec^{-1}$), indicating a quicker OER reaction rate and faster charge transfer at the electrode-electrolyte interface compared to the $FeNiVO_x$-2h at 63 $mVdec^{-1}$ and $FeNiVO_x$-1h at 72 $mVdec^{-1}$. The monometallic $Fe_2O_3$, NiO, and $VO_2$ electrodes displayed even higher Tafel slope values, indicating slower OER kinetics for those electrodes, as shown in FIG. 9D.

Figure 10A:
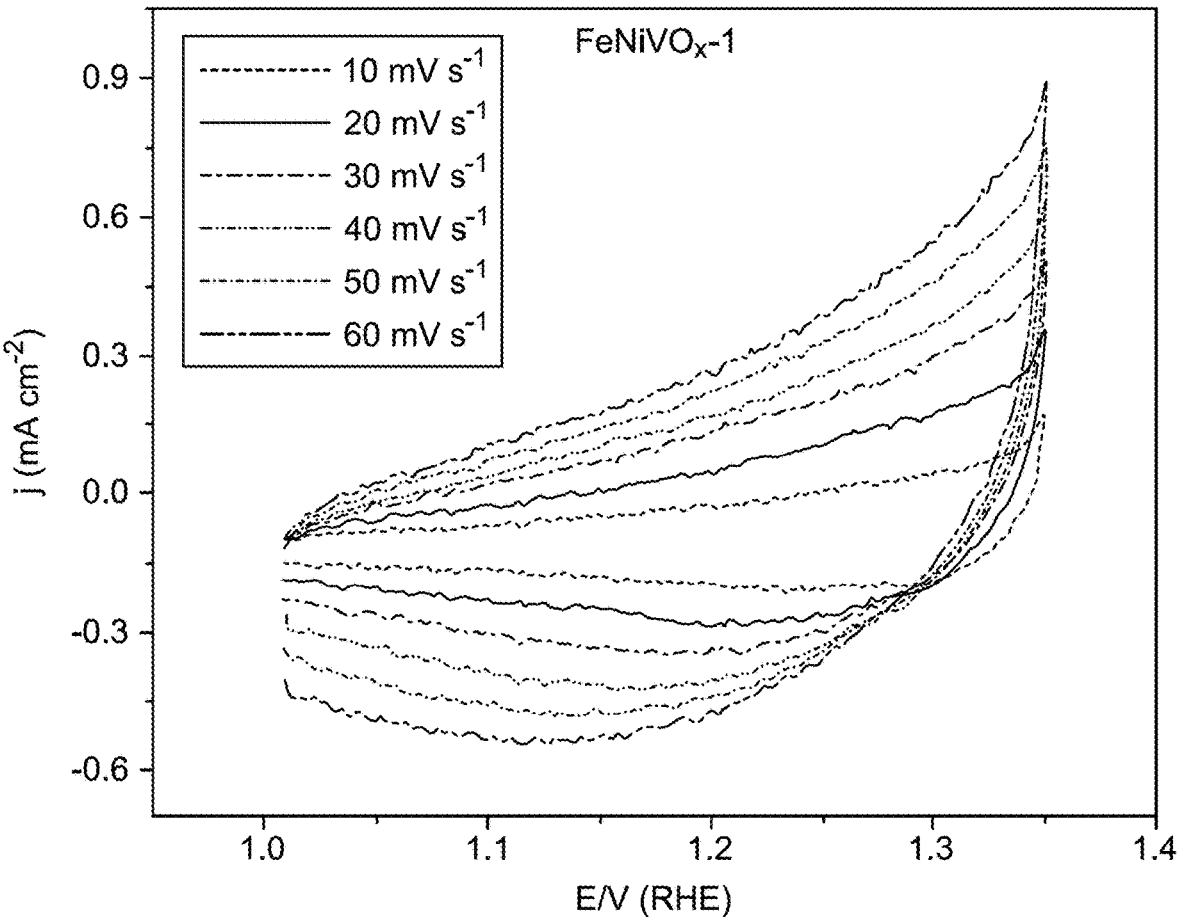
FIG. 10A shows the CV curves of the $FeNiVO_x$-1 catalyst measured in the non-faradaic region, according to certain embodiments.
Figure 10B:
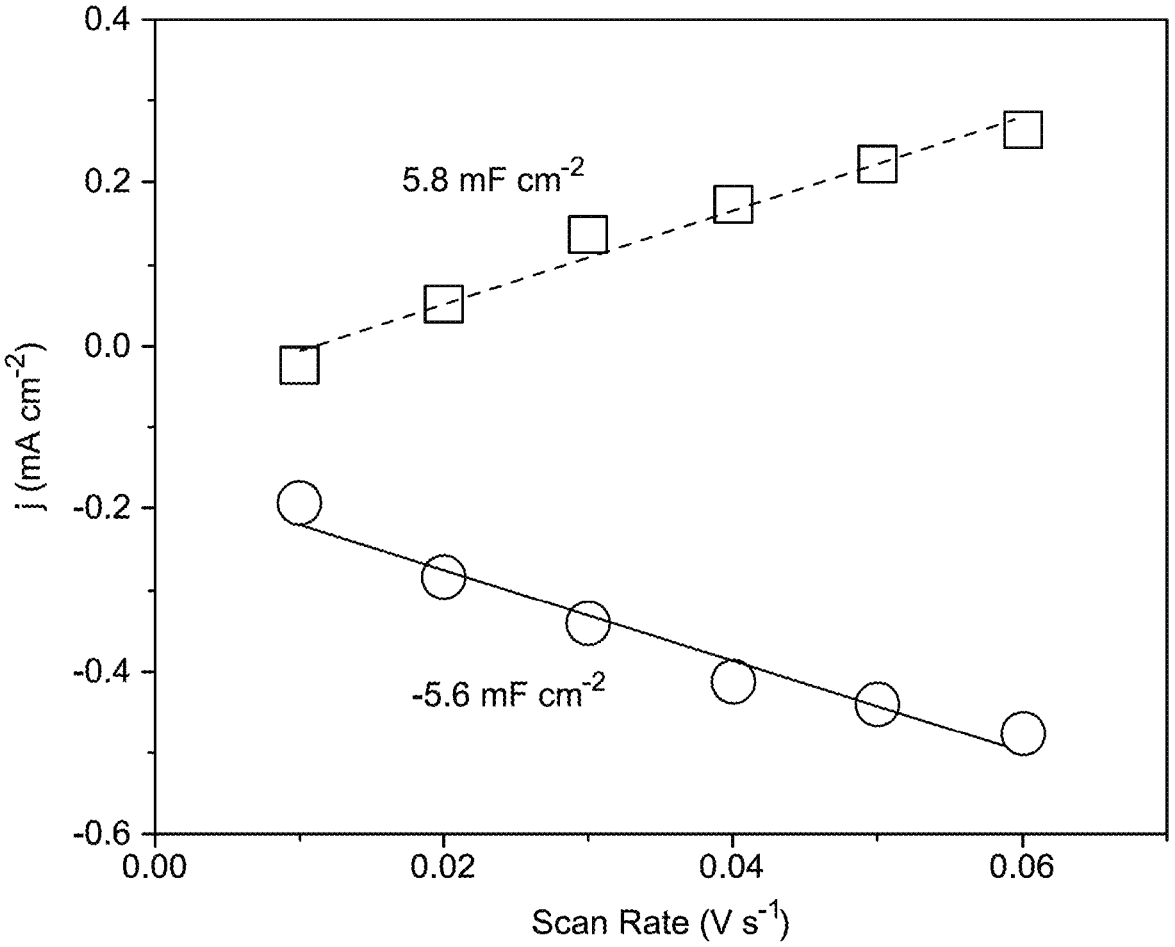
FIG. 10B shows the capacitive current density of the $FeNiVO_x$-1 catalyst plotted against the scan rate, according to certain embodiments.
Figure 10C:
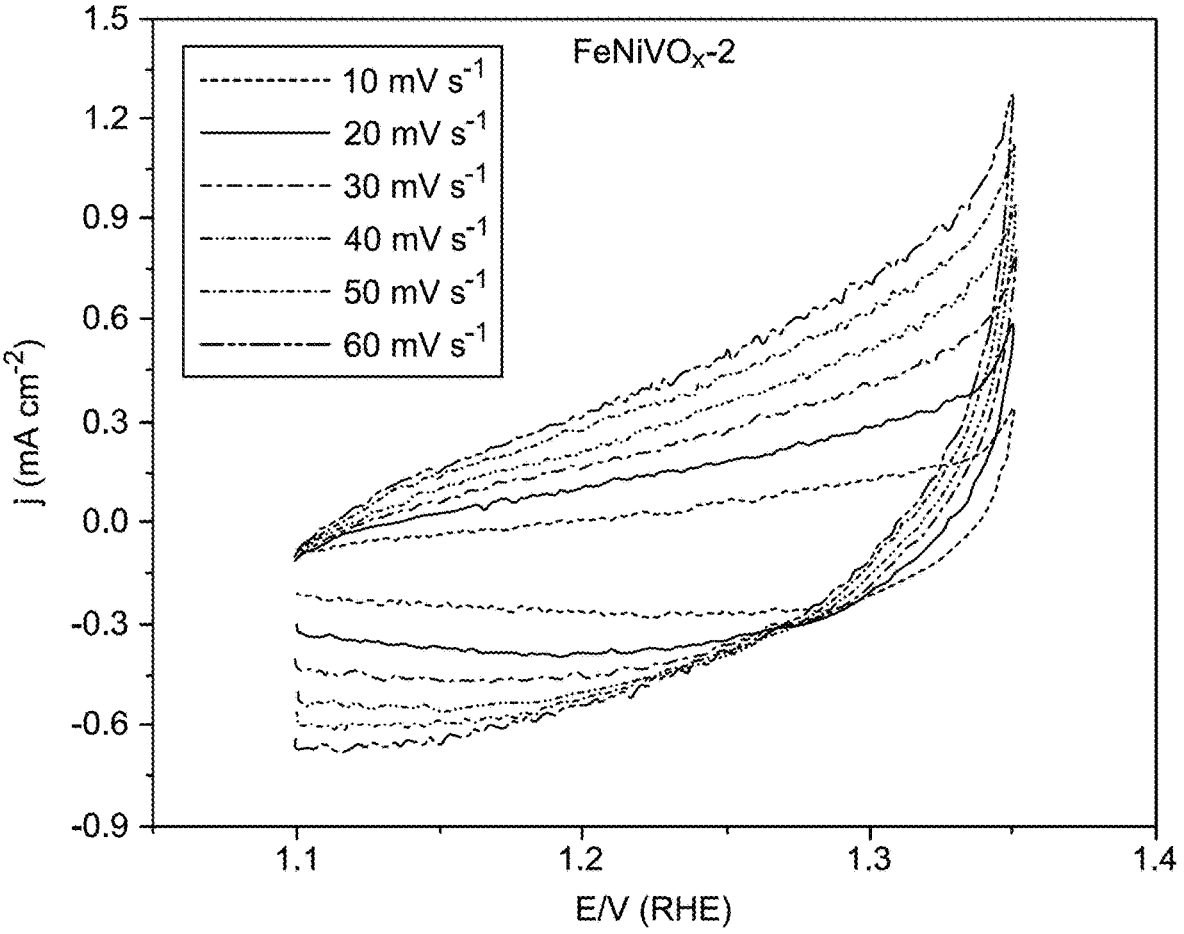
FIG. 10C shows the CV curves of the $FeNiVO_x$-2 catalyst measured in the non-faradaic region, according to certain embodiments.
Figure 10D:
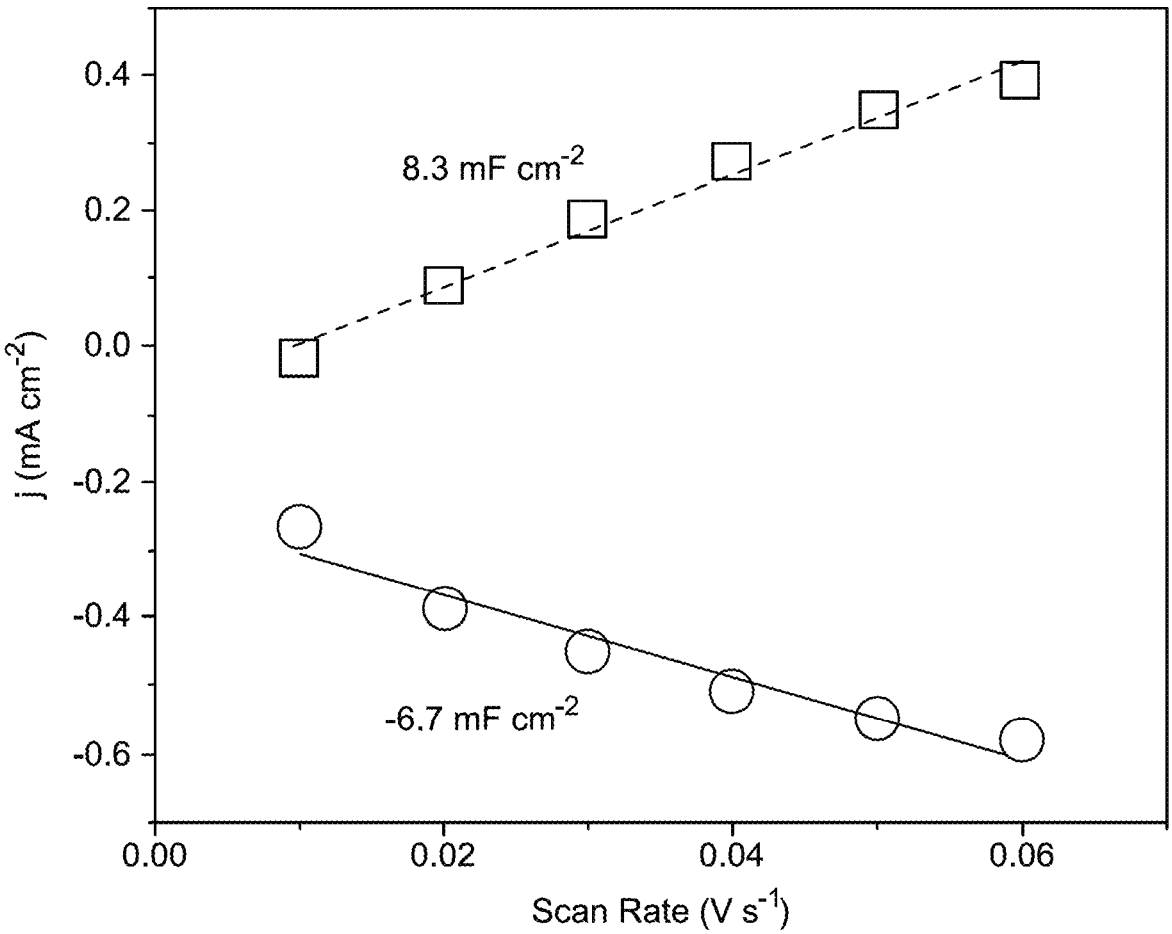
FIG. 10D shows the capacitive current density of the $FeNiVO_x$-2 catalyst plotted against the scan rate, according to certain embodiments.
Figure 10E:
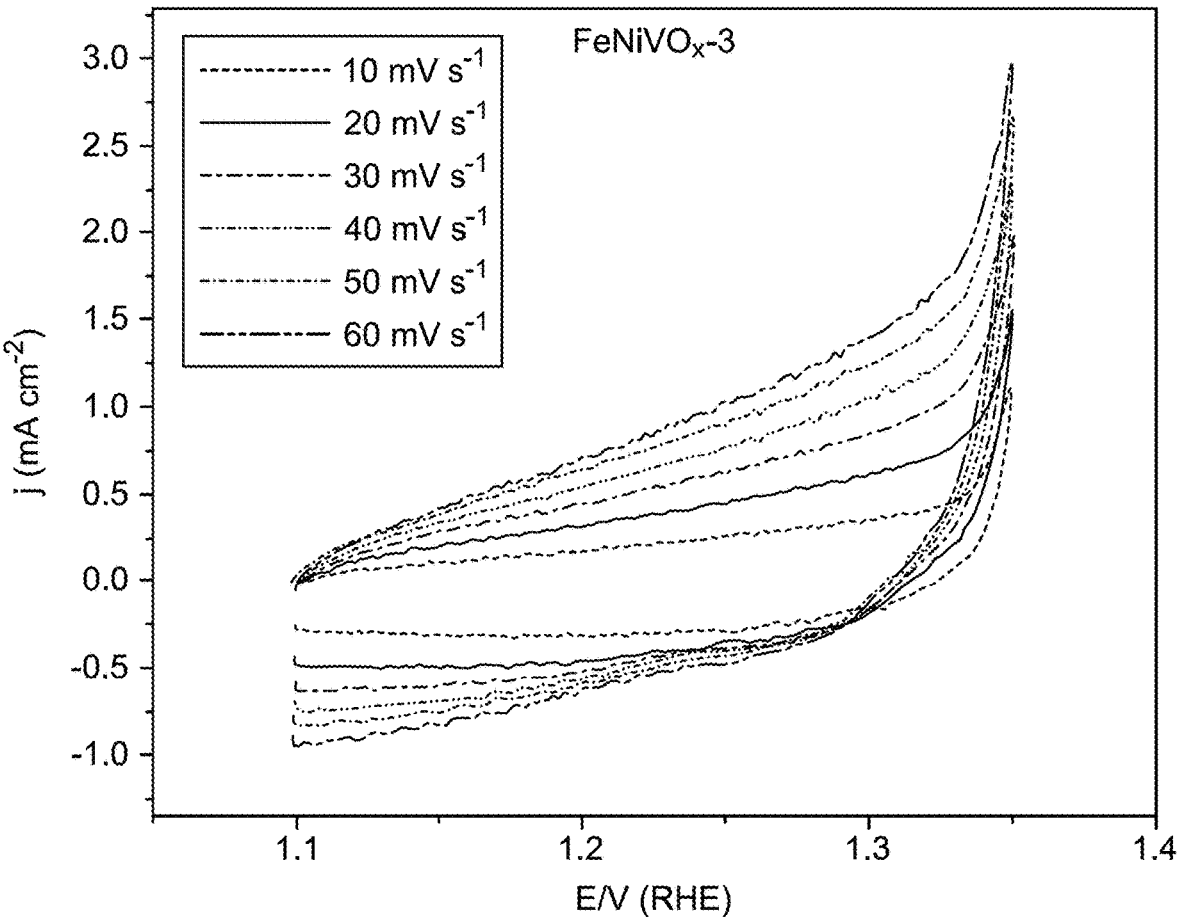
FIG. 10E shows the CV curves of the $FeNiVO_x$-3 catalyst measured in the non-faradaic region, according to certain embodiments.
Figure 10F:
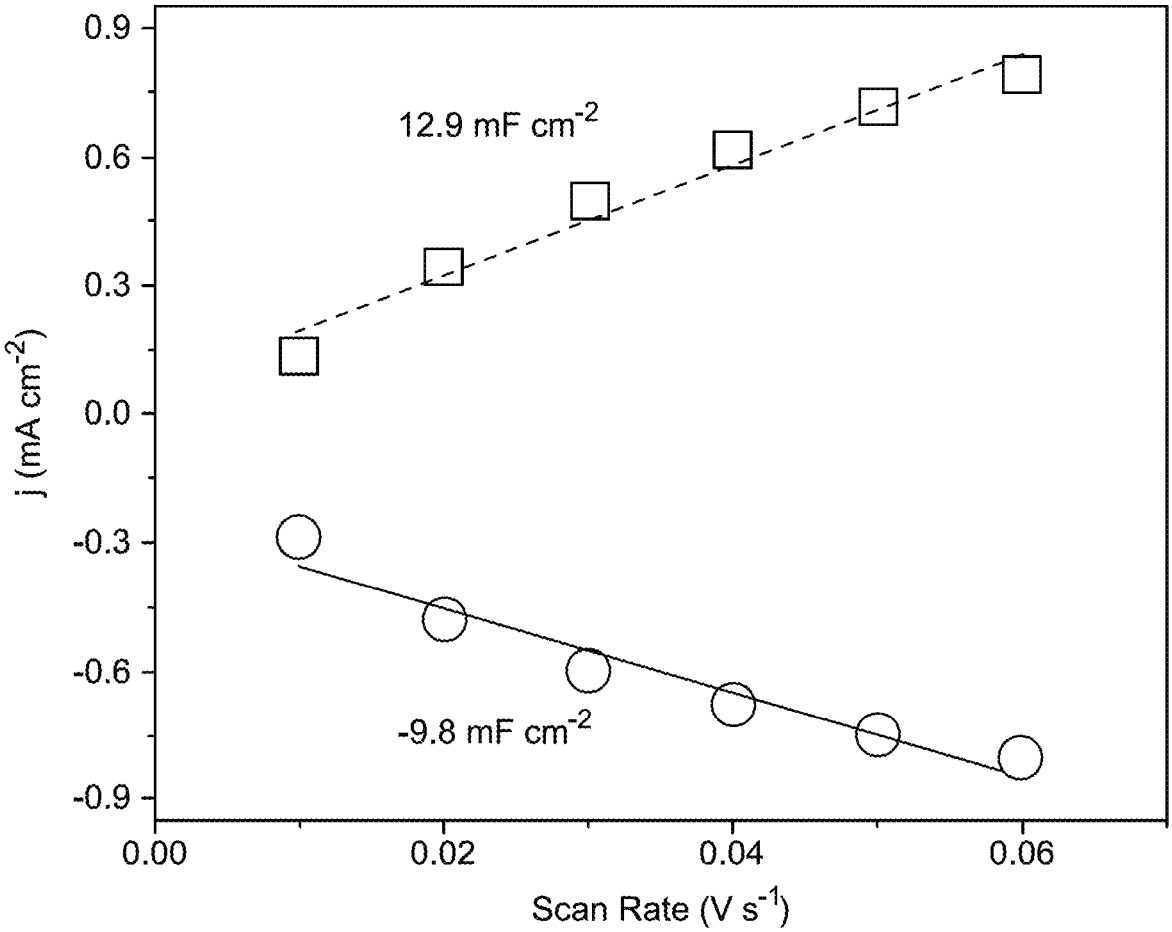
FIG. 10F shows the capacitive current density of the $FeNiVO_x$-3 catalyst plotted against the scan rate, according to certain embodiments.

The ECSA was a useful parameter for identifying the electrocatalyst with the best intrinsic OER activity. To measure the ECSA, the double layer capacitance ($C_{dl}$) was first determined by conducting CVs in the non-faradaic region. As shown in FIGS. 10A, 10C and 10E, the CV curves of trimetallic composite catalysts recorded at various scan rates ranging from 10 $mVs^{-1}$-60 $mVs^{-1}$. The cathodic and anodic slopes were derived from these CV curves, as shown in FIGS. 10B, 10D and 10F. From these observations and the calculations, it was evident that the $FeNiVO_x$-3h catalyst has a higher ECSA of 284 centimeter square ($cm^2$) compared to the $FeNiVO_x$-2h at 188 $cm^2$ and $FeNiVO_x$-1h at 142 $cm^2$, indicating the presence of more accessible active sites, thereby demonstrating enhanced OER activity.

Figure 11A:
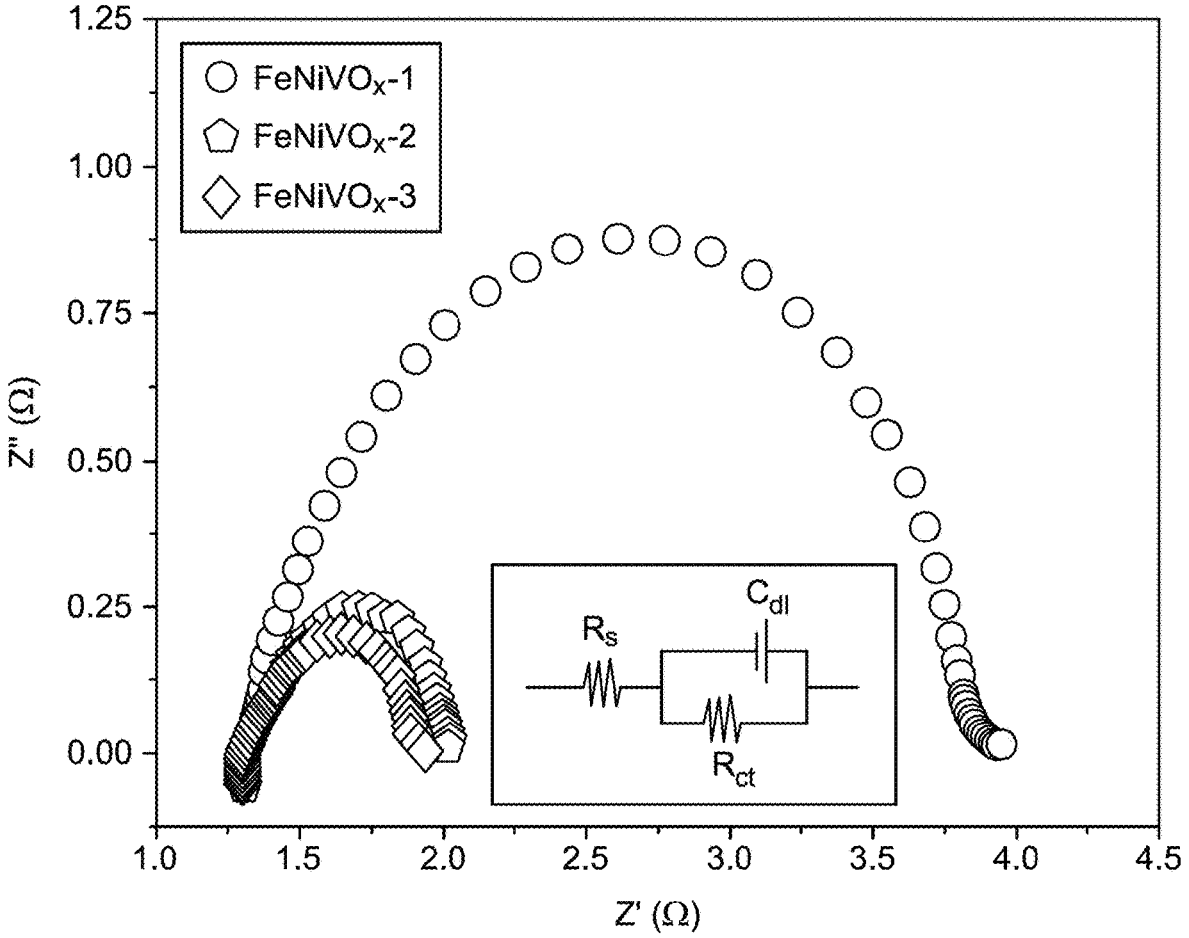
FIG. 11A shows the electrochemical impedance spectroscopy (EIS) Nyquist plots of trimetallic $FeNiVO_x$-1, $FeNiVO_x$-2 and $FeNiVO_x$-3 catalysts along with the model circuit diagram used for EIS fitting, according to certain embodiments.

The conductive behavior of the trimetallic catalysts was further examined using the EIS Nyquist study, as shown in FIG. 11A. In Nyquist plots, the arc size directly correlates with the conductivity levels of the catalytic material, with smaller arcs indicating higher conductivity. The arc diameter provides the charge transfer resistance ($R_{ct}$) value. In the present disclosure, the trimetallic $FeNiVO_x$-3h catalyst exhibited the smallest Nyquist arc and the lowest $R_{ct}$ value of 1.335Ω, demonstrating enhanced conductive behavior compared to the $FeNiVO_x$-2h and $FeNiVO_x$-1h catalysts, which had larger arc diameters and higher Ret values of 1.527Ω and 2.245Ω, respectively. These findings aligned with the structural and electrochemical characterization depicted earlier.

Figure 11B:
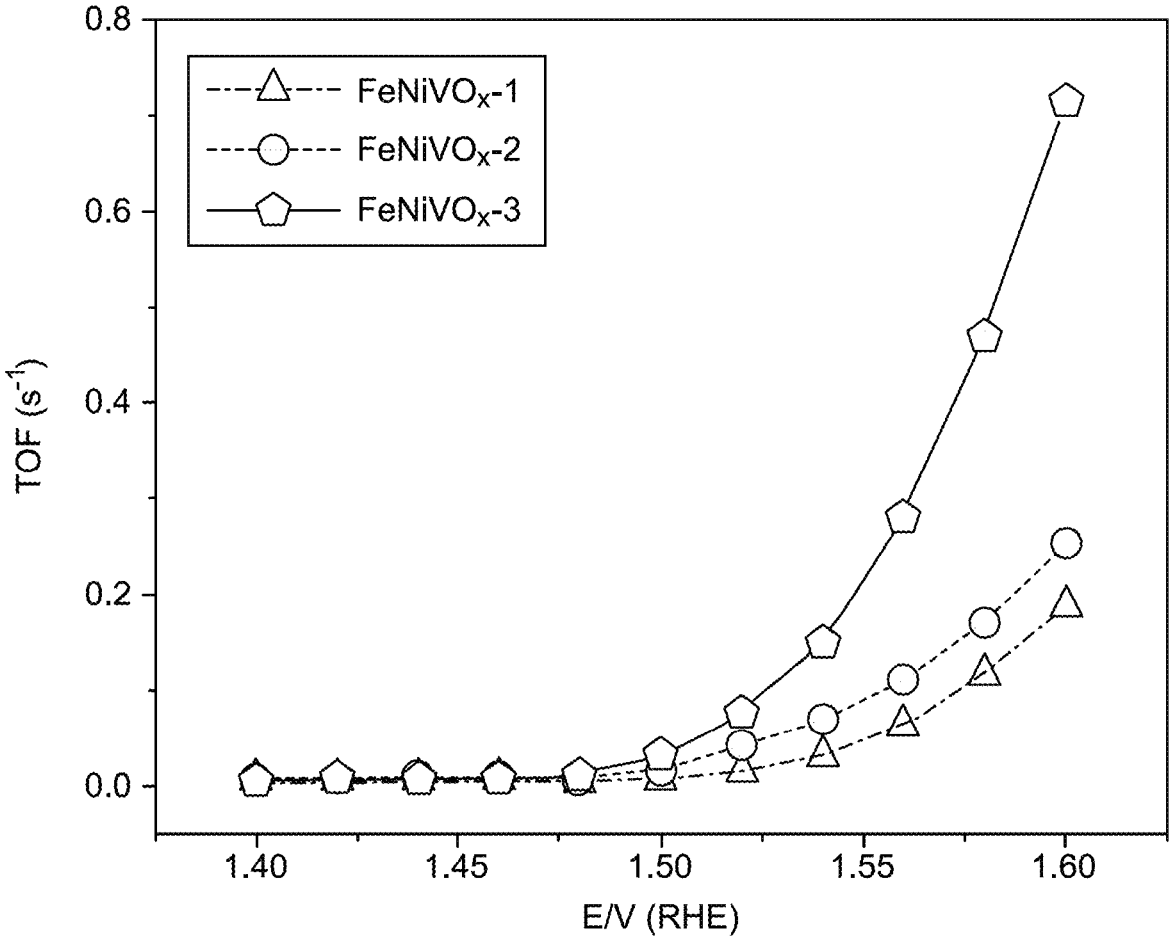
FIG. 11B depicts the turnover frequency (TOF) curves derived from the corresponding linear sweep voltammetry (LSV) measurements, according to certain embodiments.

Turnover frequency (TOF) is a useful parameter for assessing the intrinsic catalytic activity of synthesized catalysts. The TOF values of the various trimetallic catalysts were determined using the relationship Eq. (3).

$$TOF = \frac{J \times A}{4 \times F \times m} \tag{3}$$

Where A is the geometric area of $FeNiVO_x$ electrode (1 $cm^2$), m is the number of moles of catalyst deposited onto the NF substrate, and J is the current density ($Acm^{-2}$) at different values of potential, and F is the Faraday constant. The mass of the trimetallic $FeNiVO_x$ catalysts resulting from 1 h, 2 h, and 3 h of deposition was 0.08 mg, 0.2 mg, and 0.38 mg, respectively. As shown in FIG. 11B, the TOF values plotted against different overpotentials for the $FeNiVO_x$ catalysts. At an overpotential of 350 mV, the TOF values for $FeNiVO_x$-3h, $FeNiVO_x$-2h, and $FeNiVO_x$-1h were 0.72 $s^{-1}$, 0.25 $s^{-1}$, and 0.19 $s^{-1}$, respectively. The higher TOF of the $FeNiVO_x$-3h electrode demonstrated its enhanced ability to transfer charges at higher rates, making it a distinguished catalyst with enhanced OER kinetics.

Figure 11C:
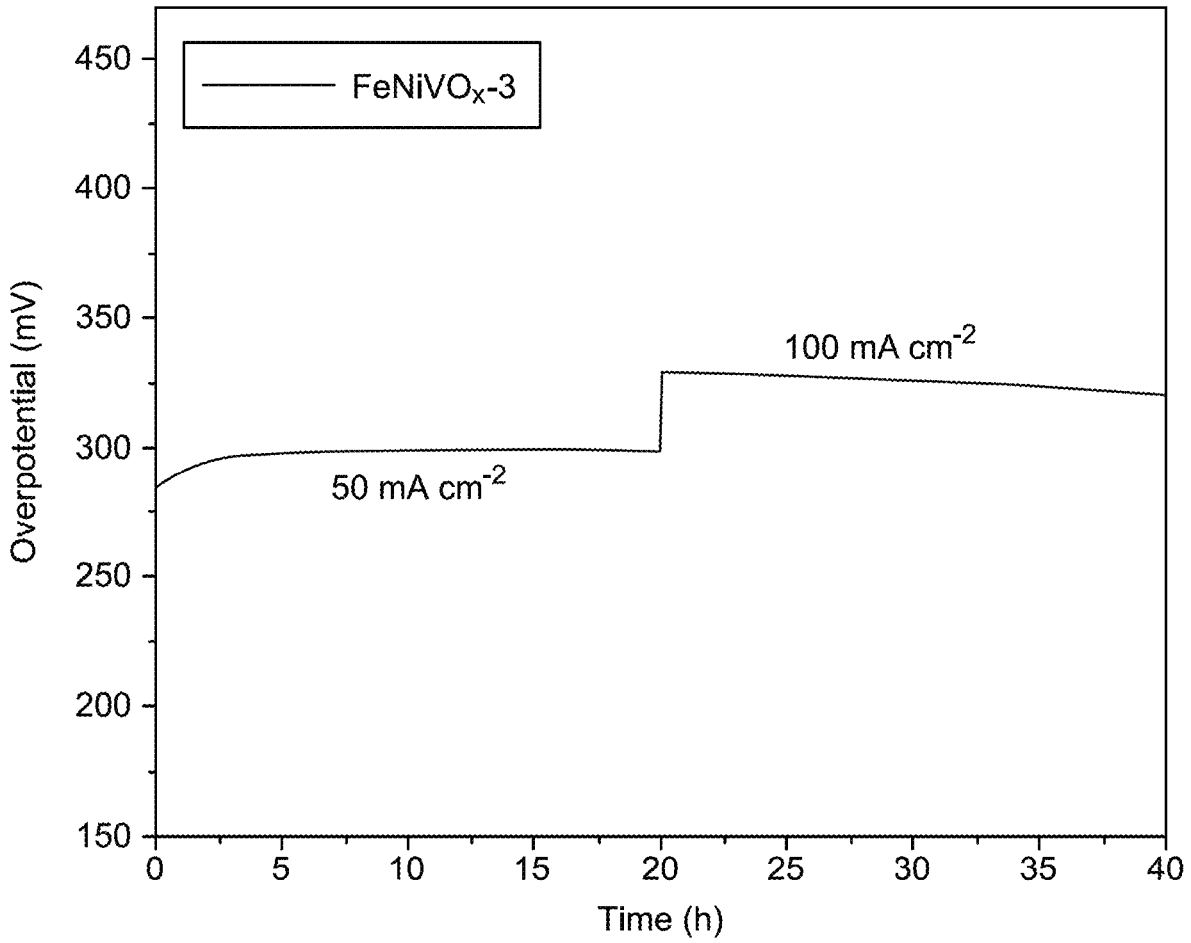
FIG. 11C shows the chronopotentiometry (CP) stability test of the $FeNiVO_x$-3h catalyst, according to certain embodiments.
Figure 11D:
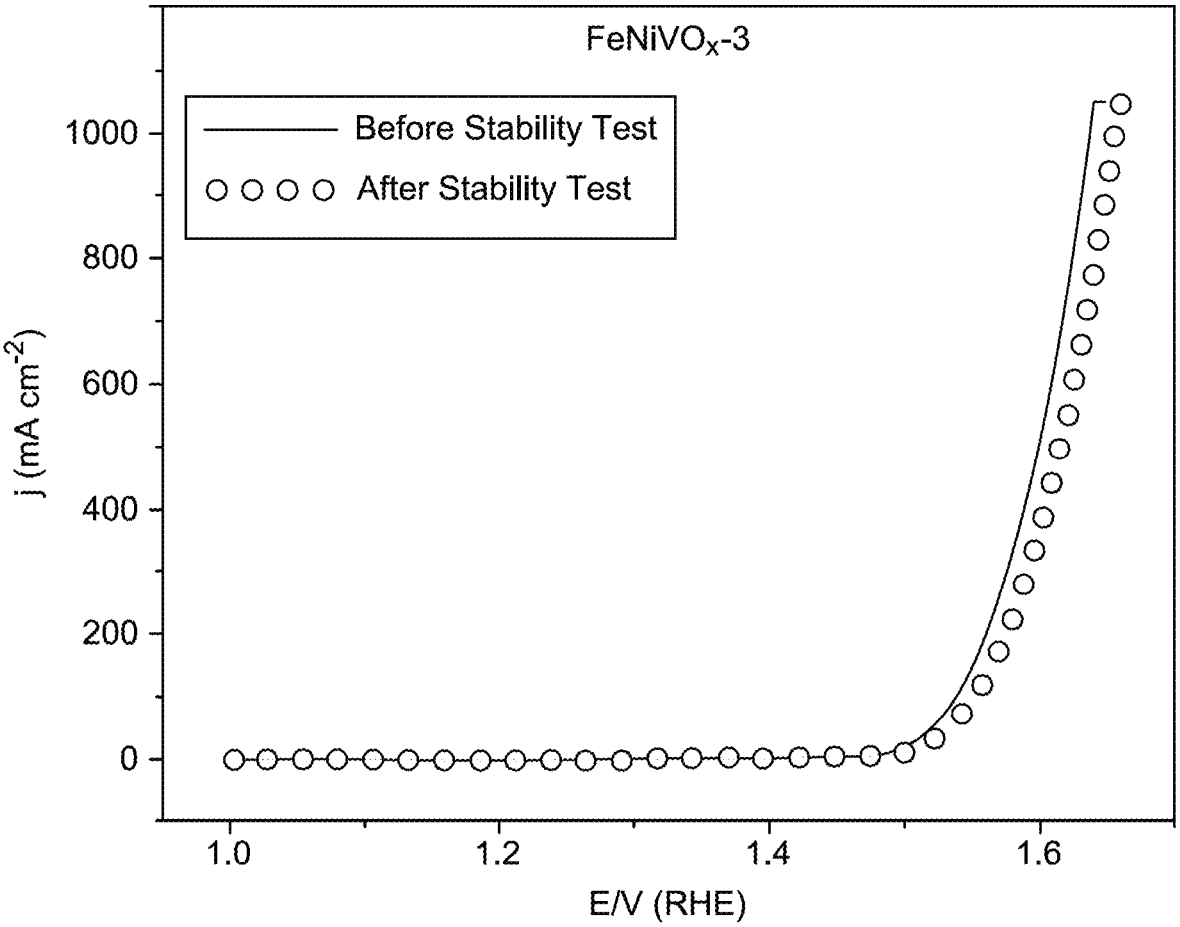
FIG. 11D shows the LSV curves of the $FeNiVO_x$-3h catalysts before and after the oxygen evolution reaction (OER) stability test, according to certain embodiments.

The electrochemical stability of the most active trimetallic $FeNiVO_x$-3h catalyst was further assessed using CP tests conducted at a current density of 50 $mAcm^{-2}$ and 100 $mAcm^{-2}$, respectively. As shown in FIG. 11C, OER stability profile was observed over a 40-h period. The trimetallic catalyst demonstrated steady and consistent OER behavior under the applied electrochemical conditions, with no decay in the potential signal. The results indicated that the trimetallic $FeNiVO_x$ catalyst was both highly active and durable, making it promising for commercial applications. After the stability examination, the polarization curve of $FeNiVO_x$ was measured again and compared with its initial state. As shown in FIG. 11D, the matching LSV trends before and after the stability test, further demonstrated the robustness of the $FeNiVO_x$ electrode even after 40 h of OER testing. This highlights an advantage of thin film electrocatalysts as active sites were regenerated as the OER process continues, allowing the catalyst to retain its activity over extended periods.

Figure 12A:
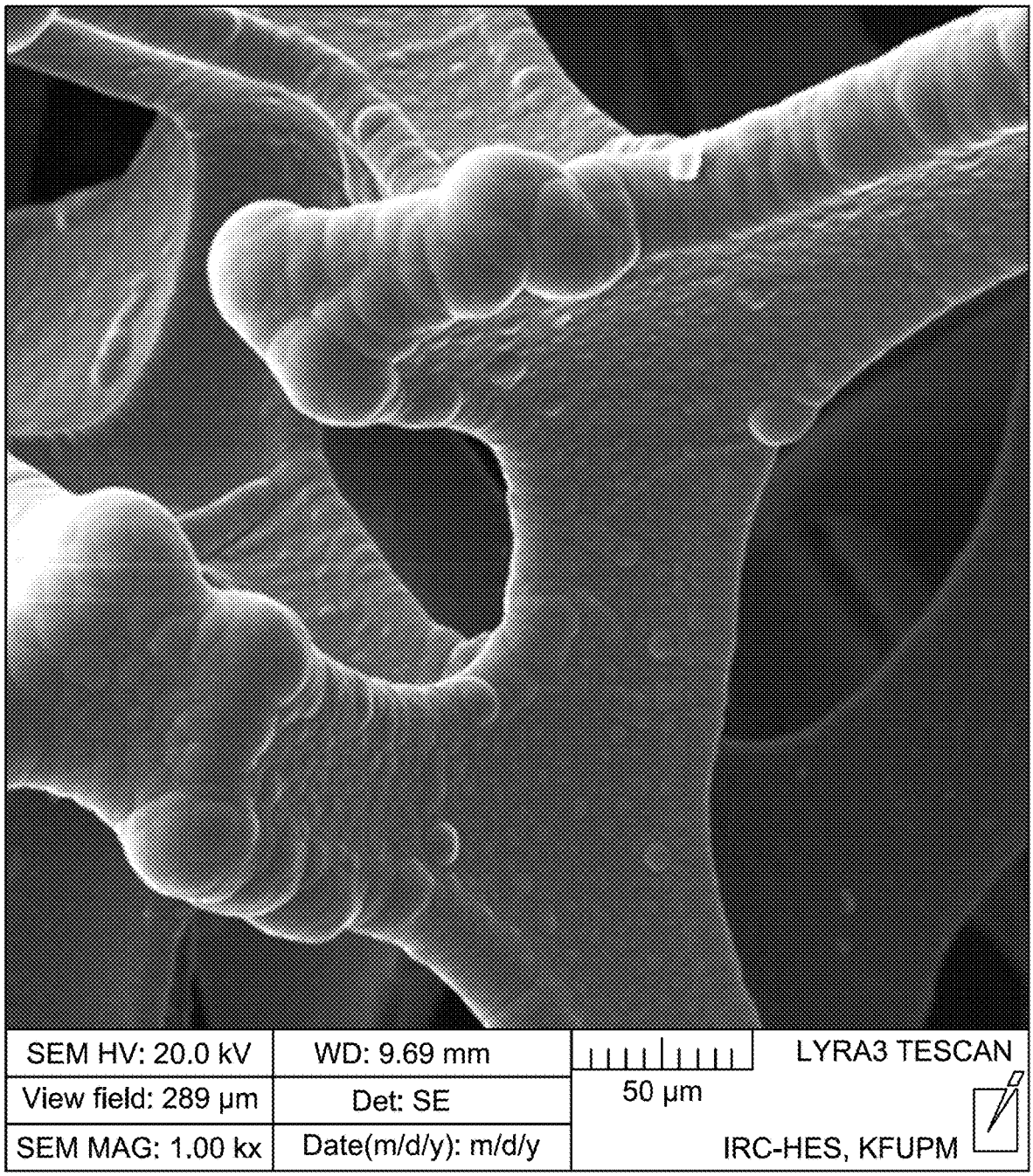
FIG. 12A is a SEM image of the $FeNiVO_x$-3h catalysts after the OER at a magnification scale of 50 μm, according to certain embodiments.
Figure 12B:
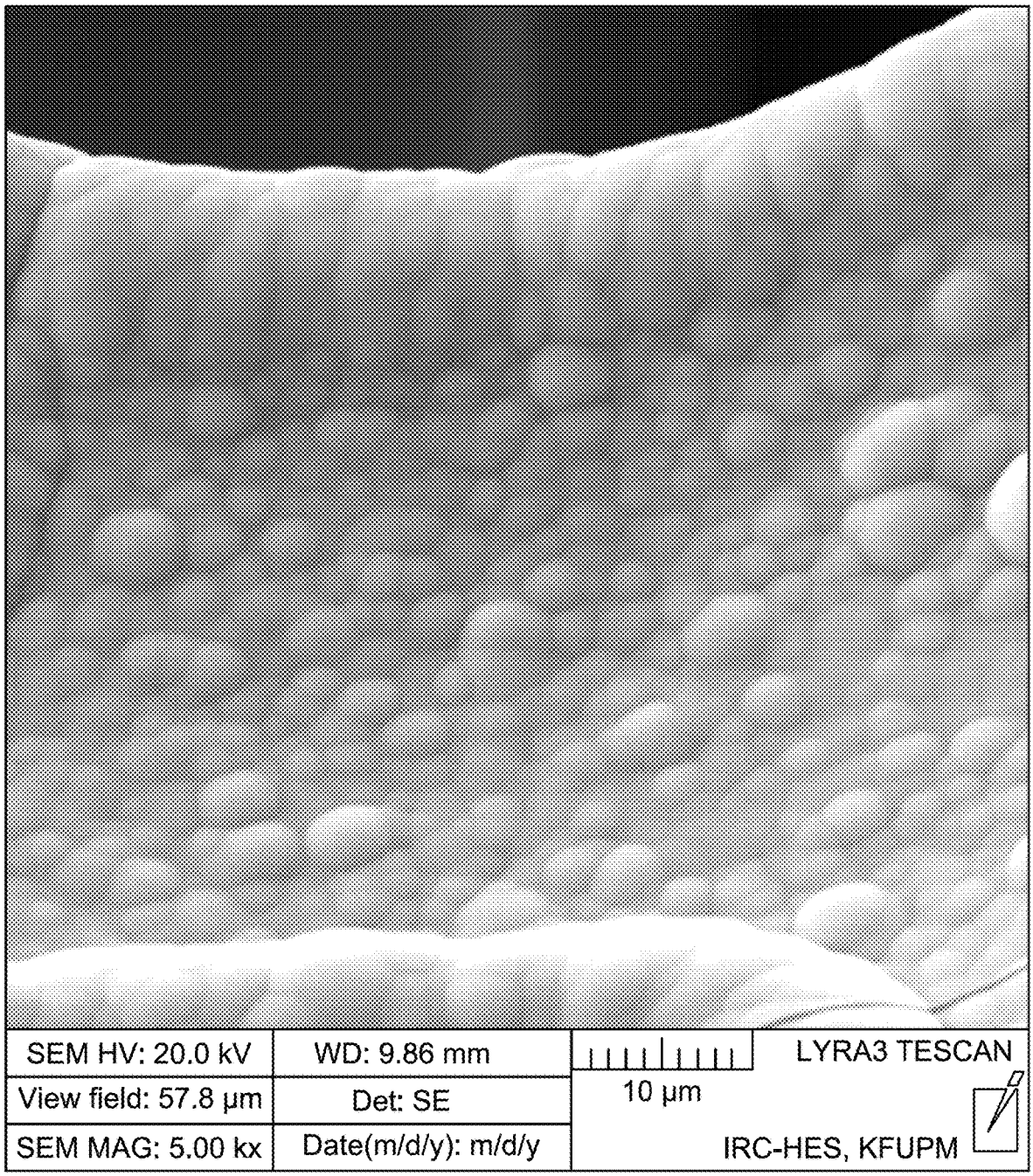
FIG. 12B is a SEM image of the $FeNiVO_x$-3h catalysts after the OER at a magnification scale of 10 μm, according to certain embodiments.
Figure 12C:
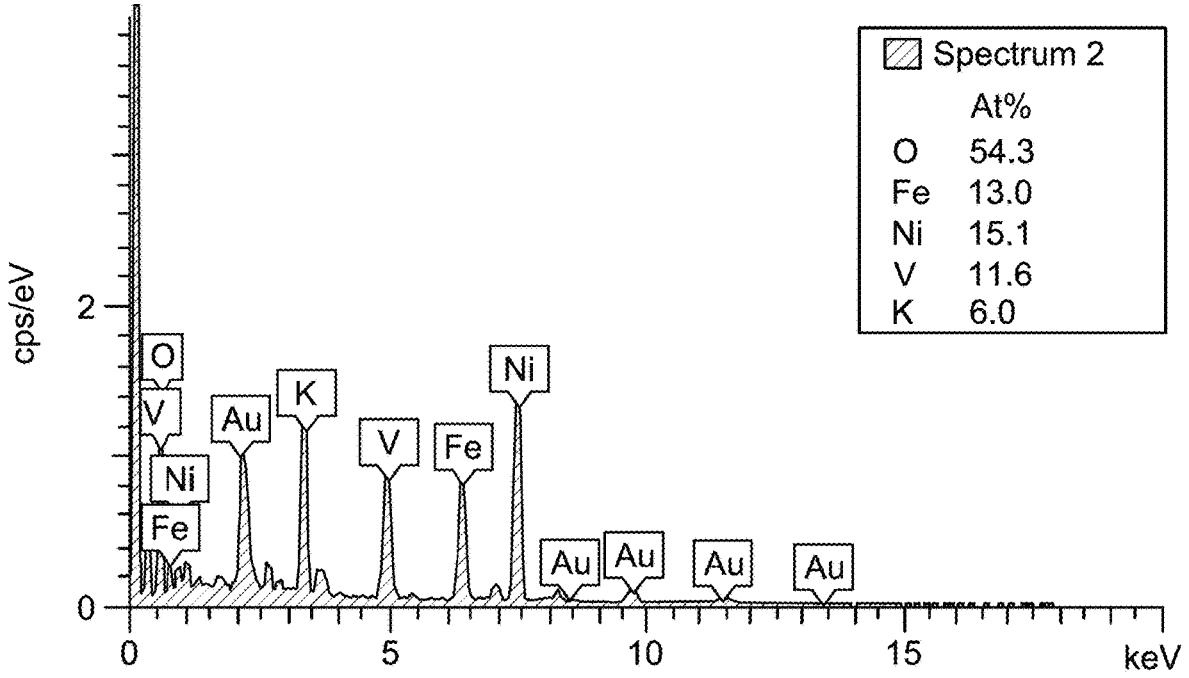
FIG. 12C depicts EDX analysis of the $FeNiVO_x$-3h catalysts after OER, according to certain embodiments.
Figure 12D:
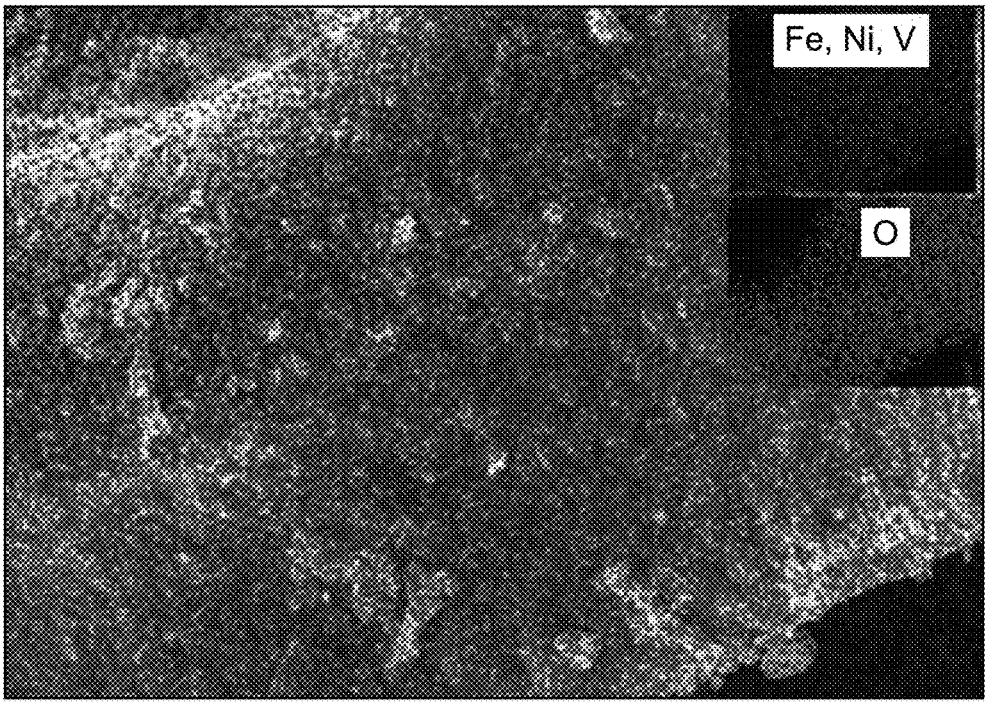
FIG. 12D shows EDX mapping analysis of the $FeNiVO_x$-3h catalysts after OER, according to certain embodiments.

The surface properties and elemental composition of the trimetallic $FeNiVO_x$ catalyst after OER experiment were analyzed using FESEM and EDX analysis. FIGS. 12A-12B shows SEM images of the $FeNiVO_x$-3h catalysts after the OER at a magnification scale of 50 and 10 μm, respectively. As shown, the spherical morphology of the $FeNiVO_x$ catalysts remained intact on the NF skeleton. FIG. 12C depicts EDX spectra and FIG. 12D depicts EDX elemental mapping analysis of the $FeNiVO_x$-3h catalysts after OER. Catalyst elements, including Fe, Ni, and V, were present, confirming that no compositional distortion occurred during OER measurements. The presence of potassium (K) was attributed to the KOH electrolyte used in OER analyses. EDX analysis also established the elemental homogeneity of Fe, Ni, and V within the catalyst.

OER performance of various potential trimetallic catalyst materials, primarily composed of 3d transition metals and fabricated through different synthesis routes were compared, as listed in Table 1. Although the electrochemical conditions may vary across these analyses, the trimetallic $FeNiVO_x$ catalyst developed in the present disclosure via the AACVD route demonstrated comparable or enhanced OER activity. A noteworthy observation was that many of the previous experiments involved complex, multi-step synthesis processes, requiring numerous chemical precursors, reagents, and heat treatments spanning several days. This complexity made catalyst fabrication less appealing for commercial applications. In contrast, the present disclosure shows that the AACVD method for fabricating thin film electrocatalysts produced trimetallic catalysts in just 3 h, offering high reproducibility and scalability potential.

TABLE 1

Summary of the various 3d-transition metals-based catalysts examined for OER in different electrochemical environment.

| Catalysts | Support | Synthetic route | Over-potential at 10 $mAcm^{-2}$ | Stability (h) | Tafel slope | Ref. |
|---|---|---|---|---|---|---|
| $FeNiVO_x$-3 h | NF | AACVD | 250 | 40 | 51 | This work |
| Iron doped cobalt vanadate (Fe-doped $Co_3V_2O_8$) | rotation disk electrode (RDE) | Solution + Hydro-thermal | 307 | 11 | 36 | 1* |
| Iron-Cobalt-Molybdenum catalyst supported on conductive paper (FeCoMo/CP) | RDE | Co-precipitation + pyrolysis | 270 | 12 | 63 | 2* |
| Iron-Cobalt-Chromium Oxide ($FeCoCrO_x$) | glassy carbon electrode (GCE) | Sol-gel | 245 | 10 | 52.4 | 3* |
| Iron-cobalt-nickel oxide-hydroxide ($FeCoNiO_xH_y$) | RDE | Solution method | 385 | 24 | 73 | 4* |
| Nickel-iron-cobalt layered double hydroxide (NiFeCo LDH) | NF | Electro-deposition | 340 | 50 | 39 | 5* |

TABLE 1-continued

Summary of the various 3d-transition metals-based catalysts examined for OER in different electrochemical environment.

| Catalysts | Support | Synthetic route | Over-potential at 10 $mAcm^{-2}$ | Stability (h) | Tafel slope | Ref. |
|---|---|---|---|---|---|---|
| Cobalt-iron-nickel molybdenum oxide graphene ($Co_2FeNi$-MOG) | GCE | Hydrogel | 267 | 33 | 23.6 | 6* |

1* Gao, T. et al., A trimetallic V—Co—Fe oxide nanoparticle as an efficient and stable electrocatalyst for oxygen evolution reaction, *J. Mater. Chem. A*, 2015, 3, 17763-17770.
2* Zhang, H. et al, Surface engineering of FeCo-based electrocatalysts supported on carbon paper by incorporating non-noble metals for water oxidation, *New J. Chem.*, 2018, 42, 7254-7261.
3* Bai, L., et al., High-efficiency electrocatalytic water oxidation on trimetal-based Fe—Co—Cr oxide, *ACS Appl. Energy Mater.*, 2019, 2, 5584.
4* Sayeed, M., et al., Electrocatalytic water oxidation at amorphous trimetallic oxides based on FeCoNiO x, *RSC Adv.*, 2017, 7, 43083-43089.
5* Babar, P. et al., Bifunctional 2D electrocatalysts of transition metal hydroxide nanosheet arrays for water splitting and urea electrolysis, *ACS Sustainable Chem. Eng.*, 2019, 7, 11, 10035-10043.
6* Lan, H., et al., Trimetallic synergistic optimization of metal-organic gels as pre-electrocatalysts for efficient electrocatalytic overall water splitting, *International Journal of Hydrogen Energy*, Volume 60, 2024, Pages 415-424, each incorporated herein by reference in their entirety.

Based on detailed structural and electrochemical characterization, the exceptional OER activity of the $FeNiVO_x$-3h catalyst may be attributed to favorable chemical interactions among 3d metal atoms (Fe, Ni, and V), which modified the electronic and conductive properties of the trimetallic catalyst system, enhancing its intrinsic catalytic activity for OER process. The spherical morphology and mass loading achieved through 3 h of deposition provided abundant exposed active sites for the oxidation reaction, facilitating the charge transfer process. Additionally, the direct vapor phase deposition onto the porous and conductive NF resulted in an adhesive and robust catalytic system without chemical binders, enabling the catalyst to maintain high current density under applied electrochemical conditions.

To conclude, trimetallic composite oxides of $Fe_2O_3$—NiO—$VO_2$ ($FeNiVO_x$) were successfully deposited on the NF support over periods of 1 h-3 h using an AACVD method. The fabricated trimetallic catalysts exhibited useful catalytic performance for OER in alkaline media. Particularly, the catalyst deposited for 3 h demonstrated effective synergistic interactions among heteroatoms, improved mass loading, and fully developed spherical microstructures. These factors resulted in a greater number of exposed active sites on the surface, enhancing the OER rate compared to other tri- and monometallic catalysts prepared by AACVD. Electrochemical measurements revealed that the catalyst achieved a benchmark current density of 10 $mAcm^{-2}$ at a relatively low potential of 1.48 V (vs. RHE) and reached a higher current density of 1000 mA $cm^{-2}$ at 1.6 V (vs. RHE). Additionally, the trimetallic catalyst exhibited excellent stability, continuously operating OER at current densities of 50 $mAcm^{-2}$ and 100 $mAcm^{-2}$ for 40 h without degradation of its compositional and morphological attributes. Furthermore, the facile, cost-effective, and convenient method for fabricating polymetallic oxide catalysts with high catalytic activity holds potential to produce water-splitting electrolyzers for renewable energy generation and environmentally friendly applications.

Numerous modifications and variations of the present disclosure are possible in light of the above teachings. It is, therefore, to be understood that within the scope of the appended claims, the disclosure may be practiced otherwise than as specifically described herein.

The invention claimed is:

1. A catalyst, including:

an iron nickel vanadium oxide ($FeNiVO_x$) nanocomposite on a nickel foam (NF), wherein the $FeNiVO_x$ nanocomposite has an iron (Fe) content in a range from 10 to 25 atomic (at. %), a nickel (Ni) content in a range from 10 to 25 at. %, and a vanadium (V) content in a range from 18 to 26 at. %, wherein the catalyst is formed through aerosol-assisted chemical vapor deposition (AACVD) depositing Fe, Ni, and V oxides onto the NF, wherein the $FeNiVO_x$ nanocomposite is in the form of solid spherical particles on the NF, wherein the NF has 20 to 60 pores per centimeter (pores/cm) and a porosity from 90 percent (%) to 99%, wherein the catalyst has an electrochemical active surface area (ECSA) greater than or equal to 140 centimeter square ($cm^2$), and wherein the catalyst has a minimum overpotential of less than or equal to 430 millivolts (mV) at 1 amperes per square centimeter ($A \cdot cm^{-2}$) when used to catalyze the oxygen evolution reaction (OER).

2. The catalyst of claim 1, wherein the $FeNiVO_x$ nanocomposite has a Fe content in a range from 14 to 18 at. %, a Ni content in a range from 15 to 19 at. %, and a V content in a range from 22 to 26 at. %.

3. The catalyst of claim 2, wherein the $FeNiVO_x$ nanocomposite has a Fe content of 16 at. %, a Ni content of 17 at. %, and a V content of 25 at. %.

4. The catalyst of claim 1, wherein the catalyst has a minimum overpotential of less than or equal to 400 mV at 1 $A \cdot cm^{-2}$ when used to catalyze OER.

5. The catalyst of claim 4, wherein the catalyst has a minimum overpotential of less than or equal to 370 mV at 1 $A \cdot cm^{-2}$ when used to catalyze OER.

6. The catalyst of claim 1, wherein the catalyst has an ECSA greater than or equal to 200 $cm^2$.

7. The catalyst of claim 6, wherein the catalyst has an ECSA greater than or equal to 280 $cm^2$.

8. The catalyst of claim 1, wherein the catalyst has a minimum overpotential of less than or equal to 320 mV at 10 $mA \cdot cm^{-2}$ when used to catalyze OER.

9. The catalyst of claim 8, wherein the catalyst has a minimum overpotential of less than or equal to 270 mV at 10 $mA \cdot cm^{-2}$ when used to catalyze OER.

10. The catalyst of claim 9, wherein the catalyst has a minimum overpotential of less than or equal to 250 mV at 10 $mA \cdot cm^{-2}$ when used to catalyze OER.

11. The catalyst of claim 1, wherein the catalyst has an onset potential of less than or equal to 300 mV at 1.51 volts (V) vs reversible hydrogen electrode (RHE) when used to catalyze OER.

12. The catalyst of claim 1, wherein the catalyst has an onset potential of less than or equal to 270 mV at 1.49 V vs RHE when used to catalyze OER.

13. The catalyst of claim 1, wherein the catalyst has an onset potential of less than or equal to 240 mV at 1.46 V vs RHE when used to catalyze OER.

14. The catalyst of claim 1, wherein the catalyst has a charge transfer resistance ($R_{ct}$) value in a range from 2.0 to 2.4 ohms (9) when used to catalyze OER.

15. The catalyst of claim 1, wherein the catalyst has an $R_{ct}$ value in a range from 1.3 to 1.7Ω when used to catalyze OER.

16. The catalyst of claim 1, wherein the catalyst has an $R_{ct}$ value in a range from 1.1 to 1.5Ω when used to catalyze OER.

17. The catalyst of claim 1, wherein the catalyst has a turnover frequency (TOF) in a range from 0.65 to 0.8 second inverse ($s^{-1}$) at an overpotential of 350 mV when used to catalyze OER.

18. The catalyst of claim 1, wherein the catalyst has a TOF in a range from 0.2 to 0.3 $s^{-1}$ at an overpotential of 350 mV when used to catalyze OER.

19. The catalyst of claim 1, wherein the catalyst has a TOF in a range from 0.15 to 0.25 $s^{-1}$ at an overpotential of 350 mV when used to catalyze OER.

* * * * *